US009109596B2

(12) United States Patent
Ohnishi et al.

(10) Patent No.: US 9,109,596 B2
(45) Date of Patent: Aug. 18, 2015

(54) VARIABLE DISPLACEMENT PUMP

(75) Inventors: Hideaki Ohnishi, Atsugi (JP); Koji Saga, Ebina (JP); Yasushi Watanabe, Kanagawa (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 252 days.

(21) Appl. No.: 13/615,709

(22) Filed: Sep. 14, 2012

(65) Prior Publication Data

US 2013/0164163 A1 Jun. 27, 2013

(30) Foreign Application Priority Data

Dec. 21, 2011 (JP) ..... 2011-279095

(51) Int. Cl.

| | |
|---|---|
| ***F03C 2/00*** | (2006.01) |
| ***F04C 2/00*** | (2006.01) |
| ***F04C 14/18*** | (2006.01) |
| ***F04C 2/344*** | (2006.01) |
| ***F04C 2/348*** | (2006.01) |
| ***F04C 14/22*** | (2006.01) |

(52) U.S. Cl.
CPC ..... *F04C 2/344* (2013.01); *F04C 2/348* (2013.01); *F04C 14/226* (2013.01)

(58) Field of Classification Search
USPC ..... 418/24–27, 30, 259, 266–268; 417/218–220, 213
See application file for complete search history.

(56) References Cited

U.S. PATENT DOCUMENTS

| | | | | |
|---|---|---|---|---|
| 4,342,545 A * | 8/1982 | Schuster | ..... | 418/26 |
| 4,737,078 A * | 4/1988 | Dantlgraber | ..... | 418/26 |
| 6,688,862 B2 * | 2/2004 | Jeronymo et al. | ..... | 418/26 |
| 8,684,702 B2 | 4/2014 | Watanabe et al. | | |
| 2010/0028171 A1 * | 2/2010 | Shulver et al. | ..... | 417/216 |

FOREIGN PATENT DOCUMENTS

| | | | |
|---|---|---|---|
| EP | 2 253 847 | 11/2010 | |
| JP | 59-058185 | 4/1984 | |
| JP | 04171288 A * | 6/1992 | ..... F04C 15/04 |
| JP | 2002-276565 | 9/2002 | |
| JP | 2008-524500 | 7/2008 | |
| JP | 2010-209718 | 9/2010 | |
| WO | WO 2006/066405 A1 | 6/2006 | |

OTHER PUBLICATIONS

U.S. Appl. No. 13/441,037, filed Apr. 6, 2012.
Koji Saga, U.S. Appl. No. 13/617,391, filed Sep. 14, 2012.
JP Office Action for Japanese Application No. 2011-279095, issued on Jun. 3, 2014.

* cited by examiner

*Primary Examiner* — Theresa Trieu
(74) *Attorney, Agent, or Firm* — Foley & Lardner LLP

(57) ABSTRACT

A variable displacement pump includes: a first control oil chamber which moves a cam ring toward a direction against a biasing force of a biasing member when a discharge pressure is introduced thereinto; a second control oil chamber which acts a hydraulic pressure upon the cam ring by cooperating with the biasing force of the biasing member when hydraulic oil is introduced thereinto; a switching mechanism which switches between one state in which hydraulic oil whose pressure is decreased than a discharge pressure is introduced to the second control oil chamber from the discharge section and another state in which hydraulic oil is discharged from the second control oil chamber; and a control mechanism operated before an eccentricity of the cam ring becomes a minimum and which discharges a greater amount of hydraulic oil within the second control oil chamber as the discharge pressure becomes larger.

18 Claims, 16 Drawing Sheets

VARIABLE DISPLACEMENT PUMP

BACKGROUND OF THE INVENTION (1) Field of the Invention

The present invention relates to a variable displacement pump for, for example, an internal combustion engine of an automotive vehicle.

(2) Description of related art

Recently, there is an industrial demand for the variable displacement pump to have a two-stage characteristic such that a required discharge pressure is maintained at a first discharge pressure in a first pump revolution speed region and the required discharge pressure is maintained at a second discharge pressure in a second pump revolution region in order to use oil discharged from the oil pump to an equipment having different required discharge pressures such as each sliding portion of the engine and a variably operated valve apparatus which controls a working characteristic of an engine valve.

In order to satisfy the above-described industrial demand, a Japanese Patent Application First Publication (tokuyou) No. 2008-524500 published on Jul. 10, 2008 (which corresponds to International Publication No. WO2006/066405) exemplifies a previously proposed variable displacement pump. In the previously proposed variable displacement pump, the cam ring is installed which is swung overcoming a biasing force of a spring, two pressure receiving chambers are installed at an outer peripheral side of the cam ring, and the discharge pressure is controlled at the two stages by selectively acting the discharge pressure upon these pressure receiving chambers to modify an eccentricity of the cam ring with respect to a rotary center of a rotor.

SUMMARY OF THE INVENTION

However, in the previously proposed variable displacement pump, the cam ring is biased by means of a relatively large spring constant. Hence, a smooth swing action toward a direction toward which a concentricity of the cam ring becomes small to a rise in the discharge pressure acted upon one of the pressure receiving chambers is impeded. Then, a discharge pressure is raised excessively largely as a pump revolution speed is raised, even if the discharge pressure is maintained at the first discharge pressure or at the second discharge pressure, and there is a possibility of a large deviation of the discharge pressure characteristic from a required discharge pressure characteristic. For example, the excessively large discharge quantity at a time of a high revolution speed of the pump is brought out and a wasteful consumption of energy is resulted.

It is an object of the present invention to provide a variable displacement pump which can suppress an excessive rise in the discharge pressure even if the pump revolution speed is raised when a request to maintain the discharge pressure at a desired discharge pressure occurs.

According to one aspect of the present invention, there is provided with a variable displacement pump comprising: a rotationally driven rotor; a plurality of vanes provided in an outer periphery of the rotor and arranged to be enabled to be moved in a radially inward direction and to be enabled to be moved in a radially outward direction; a cam ring in an inside of which the rotor and the vanes are housed, in an inner part of which a plurality of pump chambers are formed, and configured to be moved to vary an eccentricity of the cam ring with respect to a rotary center of the rotor; a housing including: a suction section formed on at least one side surface of the cam ring and opened to one of the pump chambers whose volume is increased when the cam ring is eccentrically moved toward one direction with respect to the rotary center of the rotor; and a discharge section opened to one of the pump chambers whose volume is decreased when the cam ring is eccentrically moved toward another direction with respect to the rotary center of the rotor; a biasing member configured to bias the cam ring toward the one direction toward which the eccentricity of the cam ring with respect to the rotary center of the rotor becomes large; a first control oil chamber configured to move the cam ring toward the other direction against a biasing force of the biasing member when a discharge pressure is introduced into the first control oil chamber; a second control oil chamber configured to act a hydraulic pressure upon the cam ring by cooperating with the biasing force of the biasing member when hydraulic oil is introduced into the second control oil chamber; a switching mechanism configured to switch between one state in which hydraulic oil whose pressure is decreased than a discharge pressure is introduced to the second control oil chamber from the discharge section and another state in which hydraulic oil is discharged from the second control oil chamber; and a control mechanism operated before the eccentricity of the cam ring becomes a minimum and configured to discharge a greater amount of hydraulic oil within the second control oil chamber as the discharge pressure becomes larger.

According to another aspect of the present invention, there is provided with a variable displacement pump comprising: a rotationally driven rotor; a plurality of vanes provided in an outer periphery of the rotor and arranged to be enabled to be moved in a radially inward direction and to be enabled to be moved in a radially outward direction; a cam ring in an inside of which the rotor and the vanes are housed, in an inner part of which a plurality of pump chambers are formed, and configured to be moved to vary an eccentricity of the cam ring with respect to a rotary center of the rotor; a housing including: a suction section formed on at least one side surface of the cam ring and opened to one of the pump chambers whose volume is increased when the cam ring is eccentrically moved toward one direction with respect to the rotary center of the rotor; and a discharge section opened to one of the pump chambers whose volume is decreased when the cam ring is eccentrically moved toward another direction with respect to the rotary center of the rotor; a biasing member configured to bias the cam ring in a state in which a spring load is given to the biasing member such that the eccentricity of the cam ring with respect to the rotary center of the rotor becomes large; a first control oil chamber configured to move the cam ring toward the other direction against a biasing force of the biasing member when a discharge pressure is introduced into the first control oil chamber; a second control oil chamber configured to act a hydraulic pressure upon the cam ring by cooperating with the biasing force of the biasing member when hydraulic oil is introduced into the second control oil chamber; a switching mechanismconfigured to switch between one state in which hydraulic oil is introduced from the discharge section to the second control oil chamber via an aperture to another state in which hydraulic oil within the second control oil chamber is exhausted; and a control mechanism including: a valve body having an introduction port to which the discharge pressure is introduced, a first control port communicated with the first control oil chamber, a second control port communicated with the second control oil chamber, and a drain port communicated with a drain passage; a spool valve slidably disposed within the valve body to control a communication state of each of the ports; and a control spring which biases the spool valve with a biasing force smaller than that of the biasing member, wherein the spool valve receives the discharge pressure to slide within the valve body against a biasing force of the control spring, at an initial position at which the spool valve is biased by means of the control spring to move maximally, a communication state between the introduction port and the second control port and another port than the introduction port and second control port is limited and a first state in which the first control port and the drain port are communicated with each other occurs, and, when the discharge pressure is increased, the second control port is communicated with the drain port and a second state in which the introduction port and the first control port are communicated with each other occurs.

According to a still another aspect of the present invention, there is provided with a variable displacement pump comprising: a pump constituent body configured to rotationally be driven to vary volumes of a plurality of hydraulic oil chambers to discharge oil introduced from a suction section using a discharge section; a variable mechanism configured to modify volume variation quantities of the hydraulic oil chambers opened to the discharge section according to a movement of a movable member; a biasing member configured to bias the movable member in a state in which a spring load is given to the movable member in a direction toward which the volume variation quantity of one of the hydraulic chambers opened to the discharge section becomes large; a first control oil chamber into which the discharge pressure is introduced to act a force in a direction against a biasing force of the biasing member upon the variable mechanism; a second control oil chamber into which hydraulic oil is introduced to act a force in the same direction as the biasing force of the biasing member upon the variable mechanism; a switching mechanism configured to switch between one state in which pressure decreased hydraulic oil than the discharge pressure is introduced from the discharge section to the second control oil chamber and another state in which hydraulic oil within the second control oil chamber is exhausted; and a control mechanism operated before the volume variation quantity of the hydraulic oil chamber is decreased to become a minimum by means of the variable mechanism and configured to exhaust hydraulic oil within second control oil chamber by a larger quantity as the discharge pressure becomes larger.

DETAILED DESCRIPTION OF THE INVENTION

Hereinafter, preferred embodiments of a variable displacement pump according to the present invention will be described in details on a basis of the accompanied drawings. In each of the preferred embodiments, the present invention is applicable to the variable displacement pump which supplies lubricating oil to sliding sections of an automotive internal combustion engine and which supplies hydraulic pressure as a working source of a variably operated valve mechanism through which a valve timing of an engine valve is made variable.

(First Preferred Embodiment)

Figure 1:
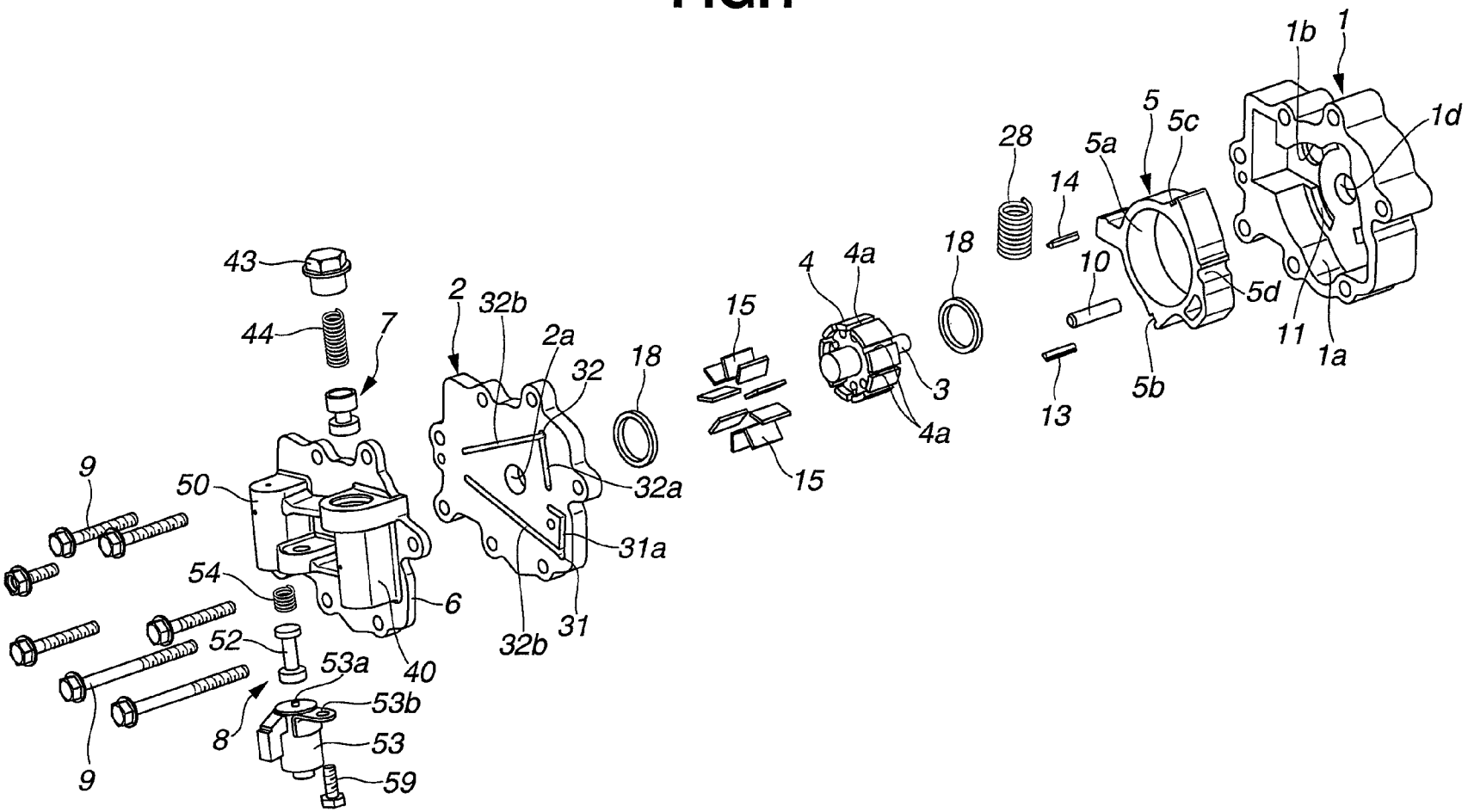
FIG. 1 is an exploded perspective view of a variable displacement pump in a first preferred embodiment according to the present invention.
Figure 2:
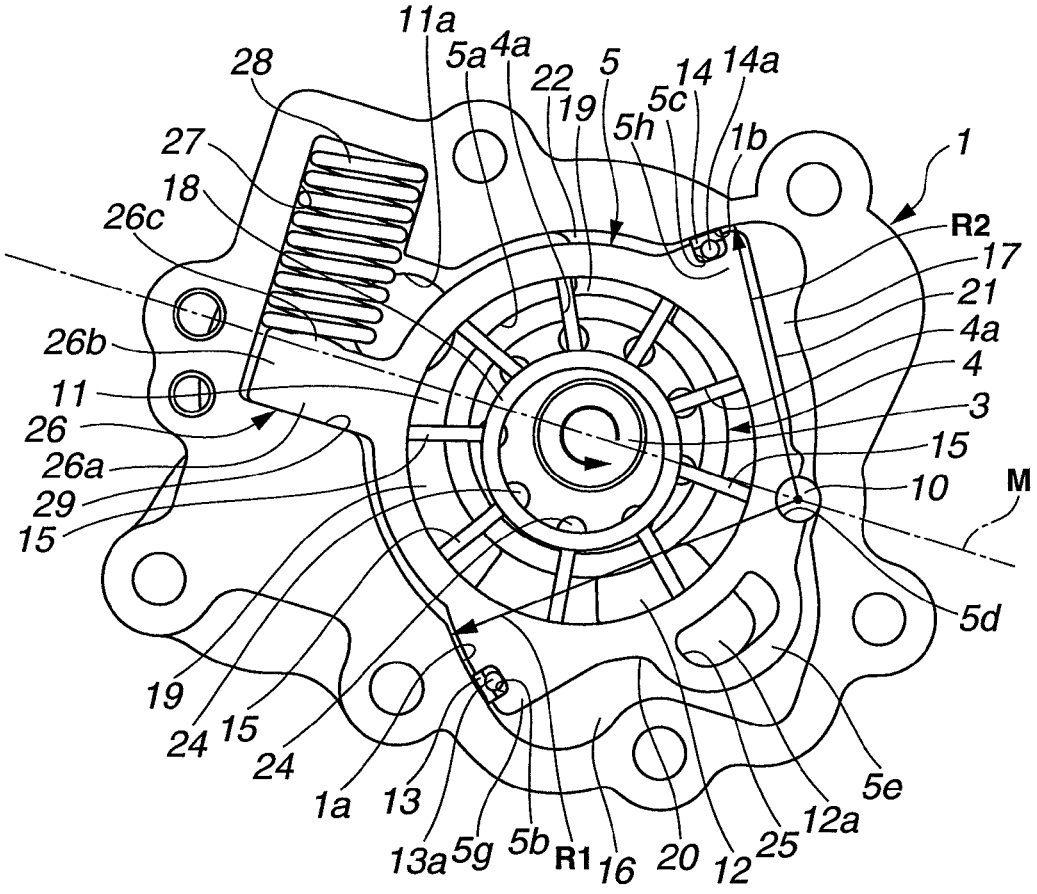
FIG. 2 is a plan view of the variable displacement pump shown in FIG. 1 when a pump cover is removed.
Figure 3:
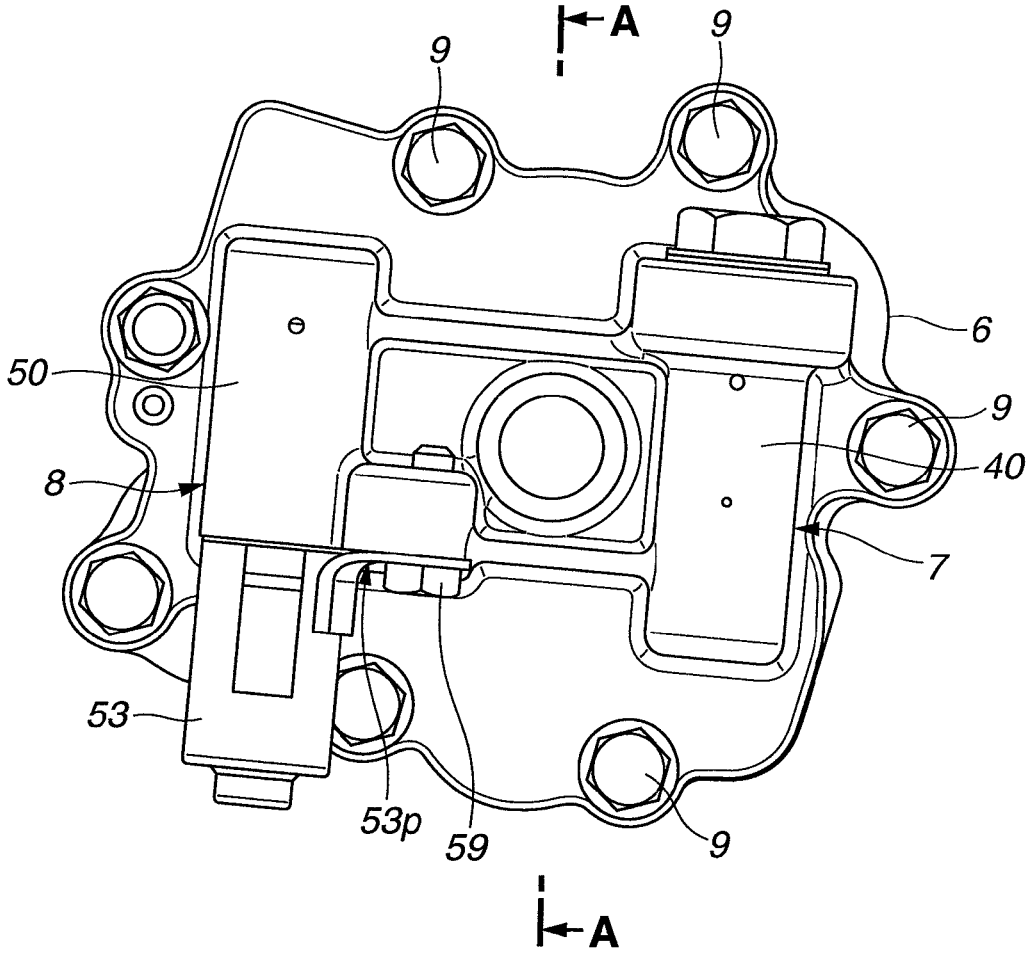
FIG. 3 is a plan view of the variable displacement pump shown in FIG. 1 when a control housing of the same variable displacement pump is attached.

The variable displacement pump in a first preferred embodiment is applicable to a vane type variable displacement pump. The variable displacement pump is mounted at a front end section of a cylinder block of the internal combustion engine. As shown in FIGS. 1 and 2, the variable displacement pump mainly includes: a pump housing 1 of a bottomed cylindrical shape, pump housing 1 having one end opening closed with a pump cover 2; a driving shaft 3 penetrated through a substantial center section of pump housing 1 and rotationally driven through an engine crankshaft of the engine not shown; a rotor 4 rotatably housed within an inner part of pump housing 1, rotor 4 having a center section coupled to driving shaft 3; a cam ring 5 which is a movable member, cam ring 5 being swingably arranged onto an outer peripheral side of rotor 4; a control housing 6 fixedly arranged on an outside surface of pump cover 2; a pilot valve 7 which is a control mechanism to control a switching of a hydraulic pressure supply; and an electromagnetic switching valve 8 which is a switching mechanism, both of pilot valve 7 and electromagnetic switching valve 8 being disposed to swing cam ring 5 and being mounted in control housing 6.

Figure 4:
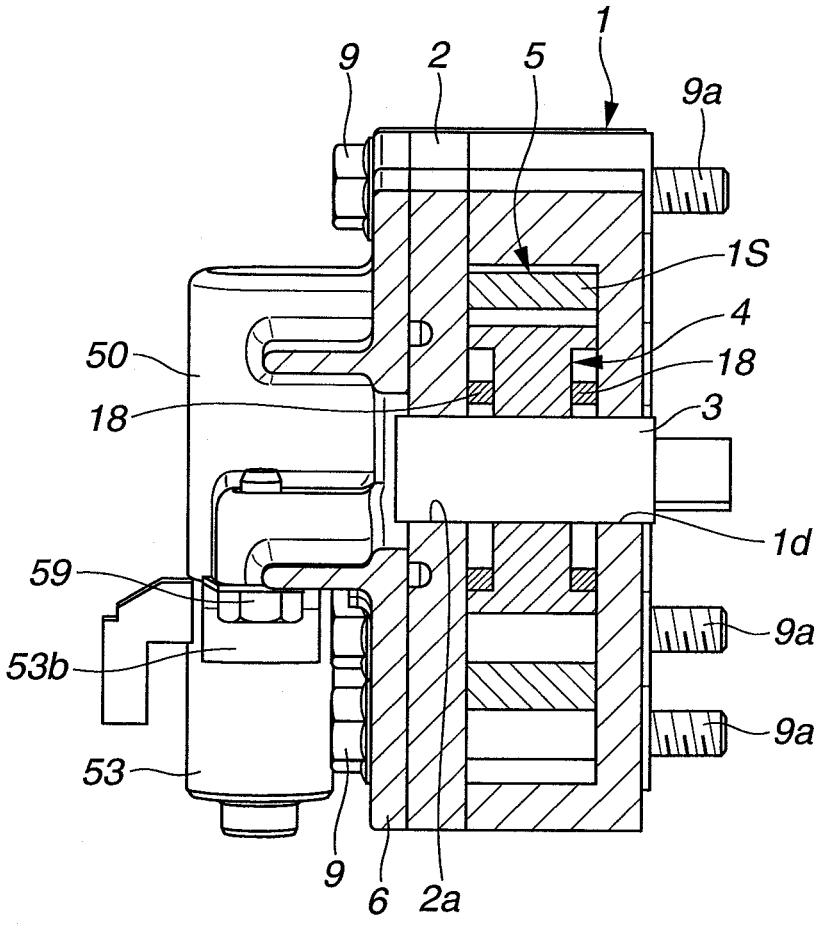
FIG. 4 is a cross sectional view of the control housing of the variable displacement pump cut away along a line of A to A in FIG. 3.

Pump housing 1, pump cover 2, and control housing 6 are integrally coupled by means of six bolts 9 when these members are mounted onto the cylinder block of the engine, as shown in FIG. 4. These respective bolts 9 are penetrated through bolt penetrating holes formed respectively within pump housing 1, control housing 6, and pump cover 2 so that tip sections 9*a* of these bolts are screwed and tightened to respective female screw holes formed within the cylinder block.

Figure 5:
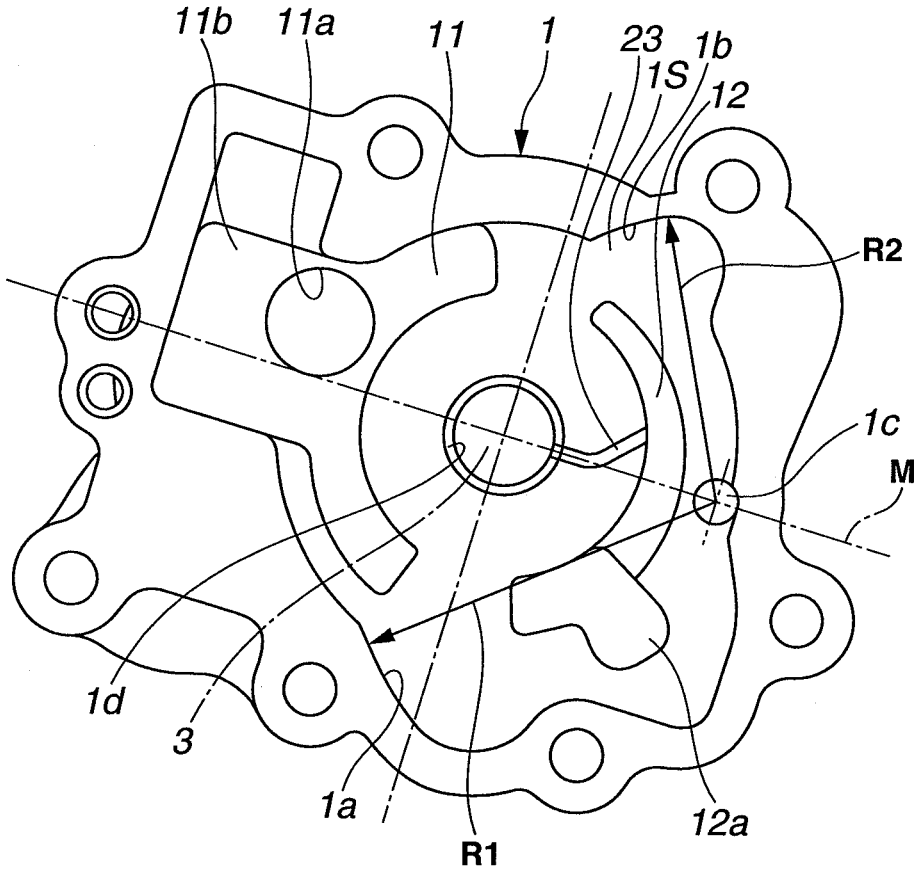
FIG. 5 is a plan view of a pump housing of the variable displacement pump in the first embodiment shown in FIG. 1.

In addition, pump housing 1 is integrally formed of an aluminum alloy material. As shown in FIG. 5, one side surface in an axle direction of cam ring 5 slidably moves on a bottom surface of a recess formed pump housing chamber 1S so that, with high accuracies of, for example, a flatness, a surface roughness, and so forth, the bottom surface is machined and a range of slide movement is formed through a machining.

Pump housing 1 includes a bearing hole id penetrated through a substantial center position of a bottom surface of a pump housing chamber 1S which provides a working chamber, as shown in FIGS. 2, 4, and 5. Bearing hole 1*d* axially supports one end section of driving shaft 3. Pump housing 1 includes a bottomed pin hole is through which a pivot pin 10 which provides a pivotal support pin of cam ring 5 is inserted is drilled at a predetermined position of an inner peripheral surface of pump housing 1. A first seal surface is formed in an arc recess shape is provided on an inner peripheral side of a vertically lower position than a straight line M (hereinafter, called a cam ring reference line) connected between an axis center of pivot pin 10 and a center of pump housing 1 (axis center of driving shaft 3). On the other hand, a second seal surface 1*b* in an arc recess shape is formed at an inner peripheral side of a vertically upper position than cam ring reference line M of pump housing 1.

A first seal member 13 fitted into a seal groove 5*b* formed on cam ring 5 (as will be described later) is, at all times (or ordinarily), slidably contacted on a first seal surface 1*a* to seal a first control chamber 16 as will be described later. A first seal mechanism is constituted by first seal surface 1*a* and first seal member 13.

A second seal member 14 fitted into a seal groove 5*c* formed on cam ring 5 (as will be described later) is, at all times, slidably contacted on a second seal surface is to seal a second control chamber 17 as will be described later. A second seal mechanism is constituted by second seal surface 1*c* and second seal member 14.

In addition, first seal surface 1*a* and second seal surface 1*b* are formed in arc surface shapes formed according to radii of R1 and R2, each having a predetermined length, with pin hole 1*c* as a center. The lengths of radii of R1 and R2 are set such that first and second seal members 13, 14 are, at all times, slidably contacted in a range in which cam ring 5 is eccentrically swung. In addition, radius R1 of first seal surface 1*a* is set to be longer than radius R2 of second seal surface 1*b* so that a volume of first control oil chamber 16 is larger than that of second control oil chamber 17.

In addition, a suction port 11 is formed on the bottom surface of pump housing 1, suction port 11 being a suction section of a substantially crescent-shaped recess shape at a left side position of driving shaft 3 as shown in FIG. 5. Then, a discharge port 12 which is a discharge section of a substantially sector recess shape is formed at a right side of driving shaft 3 (that is to say, at a position opposite to suction port 11 in the radial direction). Discharge port 12 is substantially opposed to suction port 11. It should be noted that the specific structures of discharge port 12 and suction port 11 will be described later.

Lubricating oil discharged from discharge port 12 is supplied to bearing hole 1*d* of pump housing chamber 1S for driving shaft 3 via a supply oil groove 23 formed in a substantially letter L shape and lubricating oil is supplied from an opening of supply oil groove 23 to both side surfaces of rotor 4 and a side surface of each vane 15 to secure a lubricating characteristic. It should be noted that supply oil groove 23 is formed so as not to be in agreement with a radially inward-or-outward to movement direction of each vane 15 and this causes a drop out of each vane 15 into supply oil groove 23 to be prevented when each vane 15 is moved in the radially inward-or-outward direction.

Figure 6:
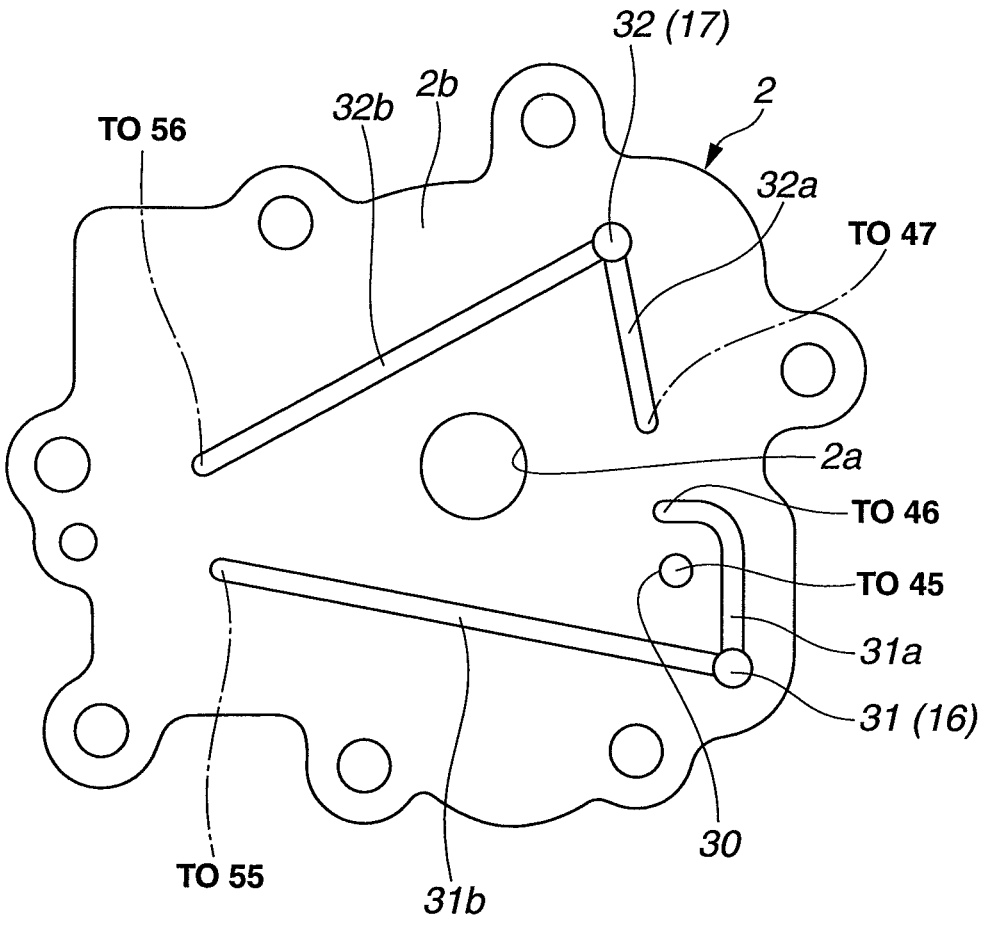
FIG. 6 is a rear view of the pump cover of the variable displacement pump in the first embodiment shown in FIG. 1.

Pump cover 2 is formed in a substantially plate is shape of an aluminum alloy material. As shown in FIGS. 1, 2, and 6, a bearing hole 2*a* is penetrated through a substantially center position of pump cover 2 to rotatably support the other end section of driving shaft 3 and a plurality of boss sections to form bolt penetrating holes are integrally formed at an outer peripheral section of pump cover 2. In addition, it is possible to form the suction port, a discharge outlet section, and an oil reservoir section at an inner side surface of pump cover 2 in the same way as the bottom surface of above-described pump housing chamber 1S, although, in this embodiment, pump cover 2 is formed in a substantially flat surface shape. In addition, this pump cover 2 is coupled to pump housing 1 by means of plurality of bolts 9 while a positioning of pump cover 2 in a circumferential direction is made via a plurality of positioning pins not shown.

Driving shaft 3 is structured to rotate rotor 4 in an arrow-marked direction (a counterclockwise direction) by means of a rotational force transmitted from an engine crankshaft to a tip section 3*a* projected from pump housing 1 via a gear so that a left side half in FIG. 2 with diving shaft 3 as a center provides a suction region and a right side half in FIG. 2 provides a discharge region.

Rotor 4 includes nine sheets of vanes 15 which are slidably retained within respectively corresponding nine slits 4*a* formed radially toward outward direction from an inner center side of rotor 4 so as to be vertically movable within nine slits 4*a*, as shown in FIGS. 1 and 2. In addition, back pressure chambers 24, each being in a substantially circular shape of cross section, are formed at base end sections of respective slits 4*a* to introduce discharge hydraulic pressure discharged into discharge port 12. This pressure within respective back pressure chambers 24 and a centrifugal force along with a rotation of rotor 4 cause vane 15 to be pressed out toward an external direction.

Each vane 15 has an inner base end edge which is slidably contacted on an outer peripheral surface of a forward-and-rearward pair of vane rings 18, 18 and has a tip edge which is slidably contacted on inner peripheral surface 5*a* of cam ring 5. A plurality of pump chambers 19 are liquid tightly partitioned between adjacent vanes 15 and among inner peripheral surface 5*a* of cam ring 5, the inner peripheral surface of rotor 4, pump housing chamber 1S, and the inside surface of pump cover 2. Each vane ring 18 is radially pressed out toward the outer direction along with the rotation. Even if an engine speed is low and the centrifugal force and the pressure within back pressure chamber 24 are small, each tip section of vanes 15 is slidably contacted on the inner peripheral surface of cam ring 5 so that each pump chamber 19 is liquid tightly partitioned.

Cam ring 5 is integrally formed in a substantially cylindrical shape and is made of an easily processed sintered metal. A pivot recessed section 5*d* is formed at a right outside position of the outer peripheral side in FIG. 2 above cam ring reference line M. Pivot pin 10 inserted into and positioned by pivot recessed section 5*d* is fitted into pivot recessed section 5*d* to provide an eccentric swing fulcrum.

In addition, a communication hole 25 which is communicated with a discharge outlet 12*a* is penetrated through a center of an arc shaped convexity section 5*e*, at a position of cam ring 5 which is lower side than cam ring reference line M. In addition, a substantially triangular shaped first projection section 5*g* which holds first seal member 13 via first seal groove 5*b* is provided at the position of cam ring 5 which is lower side than first cam ring reference line M. Furthermore, a substantially triangular shaped second projection section 5*h* to hold second seal member 14 via second seal groove 5*c* is provided at an upper position from cam ring reference line M.

It should be noted that driving shaft 3, rotor 4, vanes 15, and vane rings 18 constitute a pump constituent body.

A first control oil chamber 16 is formed at a lower side than cam ring reference line M and a second control oil chamber 17 is formed at an upper side than cam ring reference line M, with cam ring reference line M as a center. First control oil chamber 16 is disposed between an outer peripheral surface of first projection section 5*g* and pump housing 1. Second control oil chamber 17 is disposed between the outer peripheral surface of second projection section 5*h* and pump housing 1.

First control oil chamber 16 presses under pressure cam ring 5 toward a direction at which an eccentricity is decreased against a spring force of a coil spring 28 as will be described later according to the hydraulic pressure supplied to the inner side of first control oil chamber 16. In addition, first control oil chamber 16 is communicated with or not communicated with (the communication is interrupted) discharge port 12 via pilot valve 7. First control oil chamber 16 is, at all times, liquid tightly sealed by means of the first seal mechanism even when cam ring 5 is swung.

Second control oil chamber 17 presses under pressure cam ring 5 with an assistance of the spring force of coil spring 28 according to the hydraulic pressure supplied at the inner side thereof toward the direction at which the eccentricity of cam ring 5 is increased. The hydraulic pressure of second control oil chamber is supplied or discharged via electromagnetic switching valve 8 and pilot valve 7.

In addition, a distance R1 from the eccentric swing fulcrum to a first seal member 13 is set to be larger than distance R2 from the eccentric swing fulcrum to second seal member 14. Thus, an area of a first pressure receiving surface 20 which is an outside surface of cam ring 5 at first control oil chamber 16 side is set to be larger than an area of second pressure receiving surface 21 which is the outside surface of cam ring 5 toward second control oil chamber 17 side.

Hence, a pressing force to cam ring 5 according to the hydraulic pressure within first control oil passage 16 is slightly cancelled according to an opposing hydraulic pressure within second control oil chamber 17. Consequently, the discharged hydraulic pressure causes cam ring 5 to swing in a clockwise direction with pivot point 10 as a fulcrum so that a force to decrease the eccentricity by the swing in the clockwise direction with pivot pin 10 as a fulcrum becomes small. Thus, as against this, the spring force of coil spring 28 to bias cam ring 5 in the counterclockwise direction as will be described later can be set to be small.

Each of first and second seal members 13, 14 is elongated along an axis direction of cam ring 5 and is made of, for example, a synthetic resin material of a low wearability. Each of first and second seal members 13, 14 is held within seal grooves 5*b*, 5*c* formed on the outer peripheral surface of first and second projection sections 5*g*, 5*h* and is pressed toward the forward direction, namely, to each seal surface 1*a*, 1*b* according to an elastic force of resilient members 13*a*, 14*a* made of rubber and fixed onto the bottom sides of seal grooves 5*b*, 5*c*. Therefore, this secures favorable liquid tightness of first and second control oil chambers 16, 17.

Suction port 11 is opened to a region in which a volume of each pump chamber 19 is expanded, as shown in FIGS. 2 and 5, and a negative pressure generated along with a pump action by means of the pump constituent body causes lubricating oil within an oil pan 60 to be introduced via a suction inlet 11*a* formed on the substantially center of suction port 11.

In addition, an introduction section 11*b* is continuously formed at a substantially center position of an outer peripheral side of this suction port 11. This introduction section 11*b* is extended up to a spring housing section 27 as will be described later. This introduction section 11*b* is communicated with suction hole 11*a*. This suction hole 11*a* is communicated with a low pressure chamber 22 together with introduction section 11*b*. In addition, this suction hole 11*a* supplies oil sucked from oil pan 60 via a suction passage to suction port 11 according to a negative pressure generated according to a pump action of the pump constituent body and is supplied to each pump chamber 19 whose volume is expanded. Hence, a whole of suction port 11, suction inlet 11*a*, introduction part 11*b*, and low pressure chamber 22 constitute a low pressure section.

On the other hand, discharge port 12 is opened to a region in which a volume of each pump chamber 19 is reduced along with the pump action by means of the pump constituent body. Suction port 12*a* formed at the lower end side of suction port 12 is communicated with each sliding portion of the engine and variably operated valve apparatus, for example, a valve timing control apparatus via a suction passage 31 (oil main galley) shown in FIG. 9.

Cam ring 5 has an integrally formed arm 26 projected radially outwardly at a position of the outer peripheral surface of the cylindrical main body of cam ring 5 which is opposite to pivot recess section 5*d*. This arm 26, as shown in FIGS. 1 and 2, includes: an arm main body 26*a* of a rectangular plate shape, the arm main body being extended to the substantial center position in the axial direction from the forward edge end of the cylindrical main body of cam ring 5 to the substantial center position of cam ring 5; and a convexity section 26*c* integrally formed on an upper surface of tip section 26*b* of arm main body 26*a*.

A lower surface of arm main body 26*a* opposite to convexity section 26*c* of tip end section 26*b* is formed in a flat shape and, on the other hand, an upper surface of convexity section 26*c* is formed in a curved surface shape having a small radius of curvature.

In addition, a spring housing chamber 27 is formed at a position opposite to pin hole is of pump housing 1, namely, on an upper position of arm 26.

Spring housing chamber 27 is formed in a substantially flat surface rectangular shape extended along an axis direction of pump housing 1 and a coil to spring 28 is housed within an internal part of spring housing chamber 27. Coil spring 28 which is a biasing member and is housed within an internal part of spring housing member 27. Coil spring 28 which is a biasing member which biases cam ring 5 via arm 26 in the counterclockwise direction as shown in FIG. 2, namely, in the direction toward which the eccentricity between a rotary center of rotor 4 and a center of an inner peripheral surface of cam ring 5 becomes large. It should be noted that spring housing member 27 is communicated with low pressure chamber 22 via introduction section 1*b* and suction port 11.

An upper end edge of coil spring 28 is elastically contacted on a bottom surface of spring housing chamber 27 and, on the other hand, the lower end edge of coil spring 28 is elastically contacted on convexity section 26*c* of arm 26. A predetermined spring load W within spring housing chamber 27 is given to coil spring 28 within spring housing chamber 27 and coil spring 28 is biased in a direction at which the eccentricity between the rotary center of rotor 4 in cam ring 5 and the center of the inner peripheral surface of cam ring 5 becomes increased while the upper end edge of coil spring 28 is ordinarily contacted on convexity section 26*c* of arm main body 26*a*.

That is to say, coil spring 28 biases cam ring 5 always via arm 26 in the direction at which cam ring 5 becomes eccentric toward the lower direction, namely, in the direction toward which the volume of each pump chamber 19 becomes increased in a state in which spring load W is given. Spring load W is a load at which cam ring 5 is started to move with the hydraulic pressure introduced only to first control oil chamber 16 when the hydraulic pressure indicates a required hydraulic pressure P1.

In addition, a flat limitation surface 29 which limits a maximum pivot position of arm 26 in the counterclockwise direction of arm 26 when the lower surface of tip section 26*b* of arm 26 is contacted on limitation surface 29 is formed at a position opposite to spring housing chamber 27 in the axial direction thereof.

Then, a discharge pressure introducing hole 30 is penetrated through pump cover 2 at a position of pump cover 2 opposing against communication hole 25 of cam ring 5, as shown in FIG. 6, and first control hole 31 and second control hole 32 are respectively penetrated through positions of pump cover 2 opposing against first and second control oil chambers 16, 17, respectively.

Discharge pressure introducing hole 30 has one end opened to an outer side surface 2*b* of pump cover 2 and is communicated with a hydraulic pressure introduction port 45 of pilot valve 7 as will be described later.

First control hole 31 has one end opened to outer side surface 2*b* of pump cover 2, is communicated with a first pilot control port 46 of pilot valve 7 which will be described later via a first pilot oil groove 31*a* extended in an upward direction as viewed from FIG. 6, and is communicated with a first solenoid control port 55 of electromagnetic switching valve 8 as will be described later via a first solenoid oil groove 31*b* extended in a left upward direction as viewed from FIG. 6.

On the other hand, second control hole 32 has one end opened to outer side surface 2*b* of pump cover 2 and is communicated with a second pilot control port 47 of pilot valve 7 via a second pilot oil groove 32*a* extended in the lower direction as will be described later. Second control hole 32 is communicated with a second solenoid control port 56 of the solenoid valve as will be described later via a second pilot oil groove 31*b* extended in the left lower direction as viewed from FIG. 6.

Figure 7:
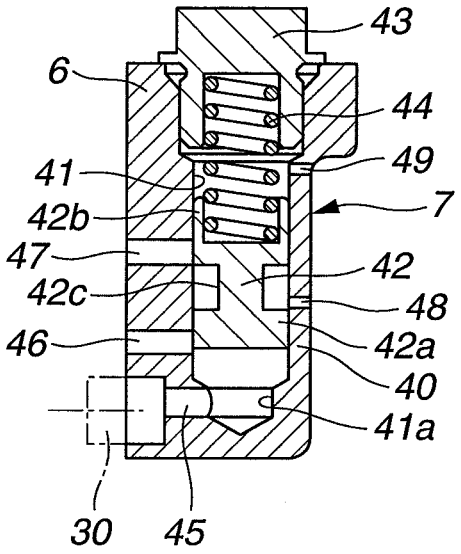
FIG. 7 is a longitudinal cross sectional view of a pilot valve of the variable displacement pump in the first embodiment shown in FIG. 1.

Pilot valve 7, as shown in FIGS. 1 and 7, includes: a first valve body 40 in a lidded cylindrical shape in which a bottom section is closed, first valve body 40 being provided in a vertical direction and being integrally provided at an outer surface one side section of control housing 6; a first spool valve 42 vertically slidable within a first valve hole 41 formed in an inner part of first valve body 40; a first valve spring 44 which biases first spool valve 42 in the lower direction, first valve spring 44 being elastically interposed between a plug 43 which closes an upper end opening of first valve hole 41 and first spool valve 42.

First valve body 40 includes: hydraulic pressure introduction port 45 penetrated through the lower end section of a side wall of control housing 6 along a horizontal direction. Hydraulic pressure introduction port 45 communicates with discharge pressure introducing hole 30 and a small-diameter tip section 41*a* of first valve hole 41. An outside of hydraulic pressure introduction port 45 is formed in a large diameter shape and an inside thereof is formed in a small diameter shape communicated with above-described small-diameter tip section 41*a* from a right angle direction.

In addition, first pilot control port 46 which communicates between first pilot oil groove 31*a* and first valve hole 41 is penetrated through the upper position of hydraulic pressure introduction port 45 and second pilot control port 47 which communicates between second pilot oil groove 32*a* and first valve hole 41 is penetrated through the upper position of first pilot control port 46.

Furthermore, a small-diameter first drain port 48 is penetrated through a substantial center position of the peripheral wall of first valve body 40 in the axis direction thereof and a small-diameter breathing hole 49 which is opened to the atmosphere is penetrated through an upper position in the axis direction of the peripheral wall. It should be noted that breathing hole 49 is provided to secure a smooth sliding characteristic of first spool valve 42 and is formed at a position higher than first and second control oil chambers 16, 17 to suppress a flowing in of air to respective control oil chambers 16, 17.

First spool valve 42 includes a first valve body 42*a* and a second valve body 42*b* at upper and lower positions of first spool valve 42 with a circular groove 42*c* formed at a substantial center of the outer peripheral surface in the axis direction of the first spool valve 42 as a center. These first and second valve bodies 42*a*, 42*b* serve to vary an opening area of hydraulic pressure introduction port 45. It should be noted that this first spool valve 42 biases hydraulic pressure introduction port 45 to be closed according to the spring force of first valve spring 44.

Figure 9:
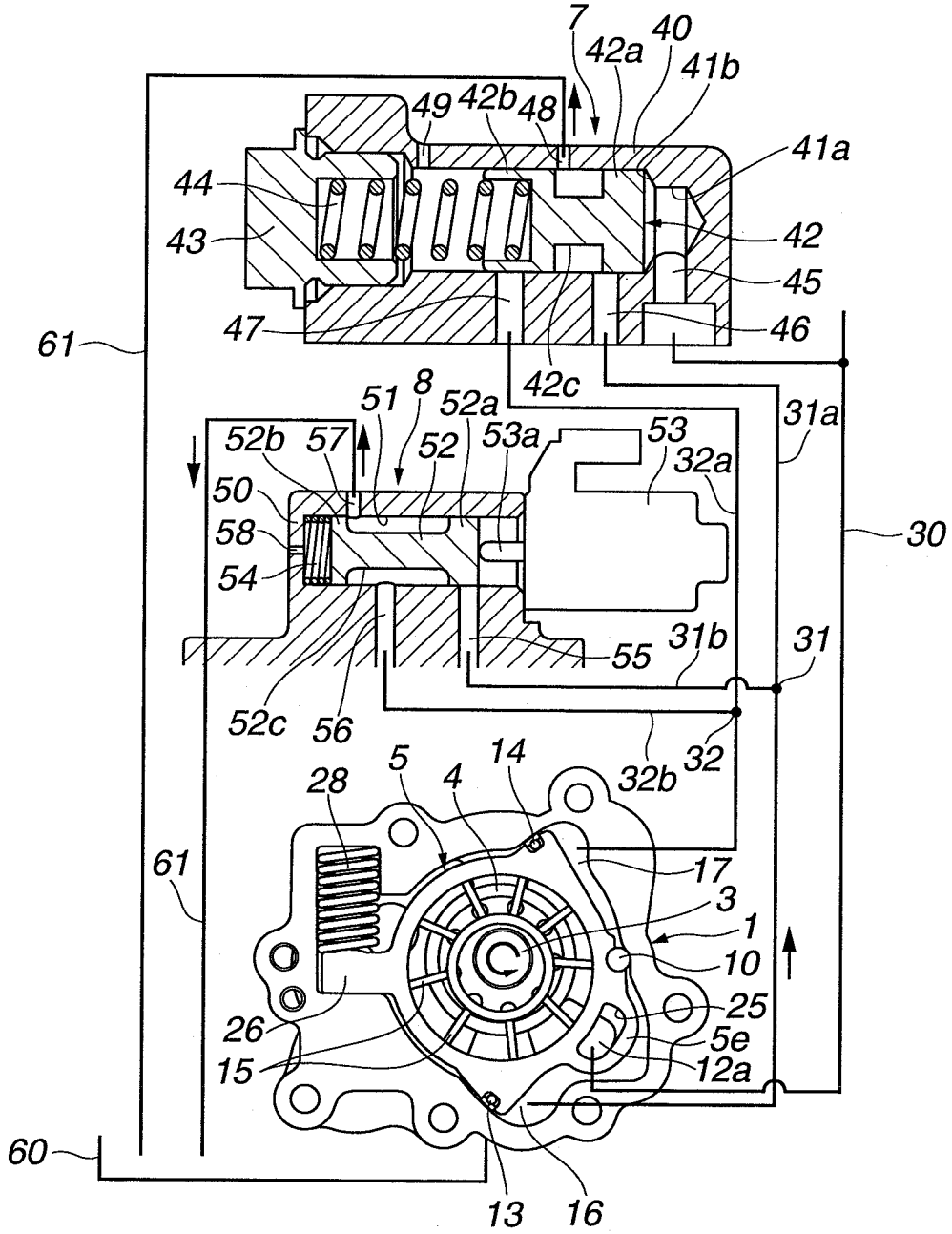
FIG. 9 is an explanatory view for explaining an action of the variable displacement pump in the first embodiment at an initial stage of an engine start.

It should be noted that first drain port 48 is communicated with oil pan 60 via a drain passage 61 shown in FIG. 9.

[A basic Operation of Pilot Valve 7]

A basic operation of pilot valve 7 will, hereinafter, be explained.

(First State)

Figure 12:
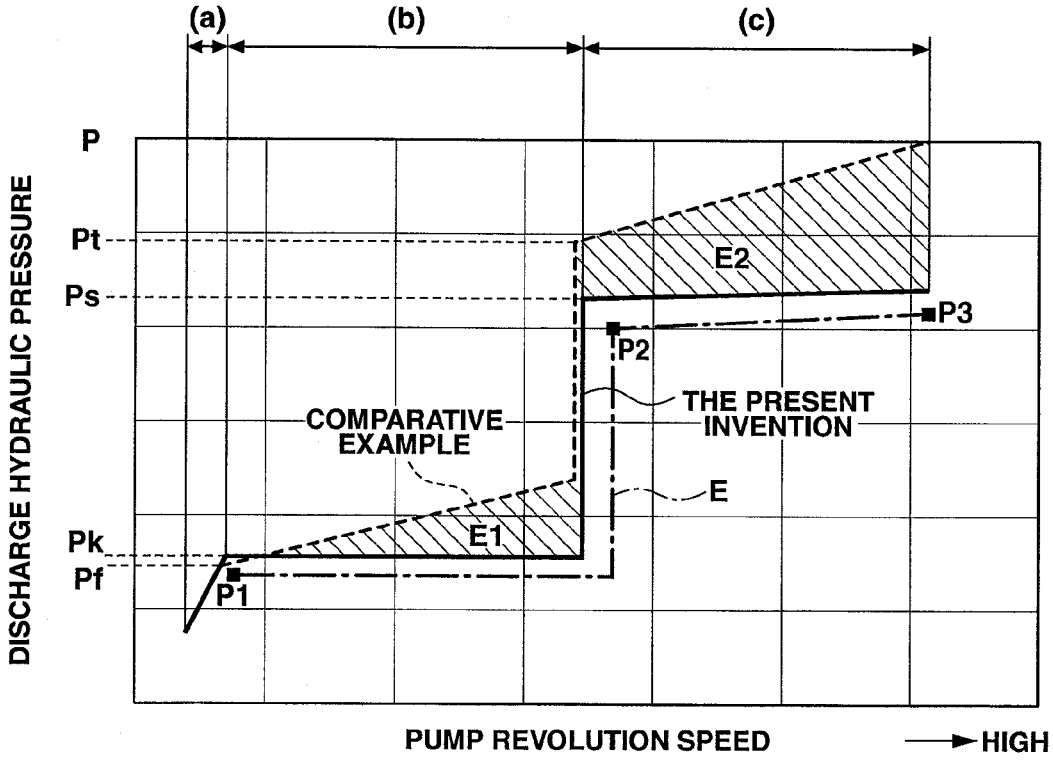
FIG. 12 is a characteristic graph representing a relationship between a discharge hydraulic pressure and an engine speed (or a pump revolution speed) of the variable displacement pump in the first embodiment.

First, in a case where the hydraulic pressure is not introduced to hydraulic pressure introduction port 45, or in a case where the hydraulic pressure is smaller than $P_k$ in FIG. 12, first spool valve 42 is moved maximally toward the rightward direction (lower direction) according to the spring force of first valve spring 44 so as to close the opening end of hydraulic pressure introduction port 45. At this time, the communication of first pilot control port 46 is interrupted according to hydraulic pressure introduction port 45 and first valve body 42*a* and first pilot control port 46 is communicated with first drain port 48 and the opening end of second pilot control port 47 is closed by means of second valve body 42*b*.

(Second State)

Figure 10:
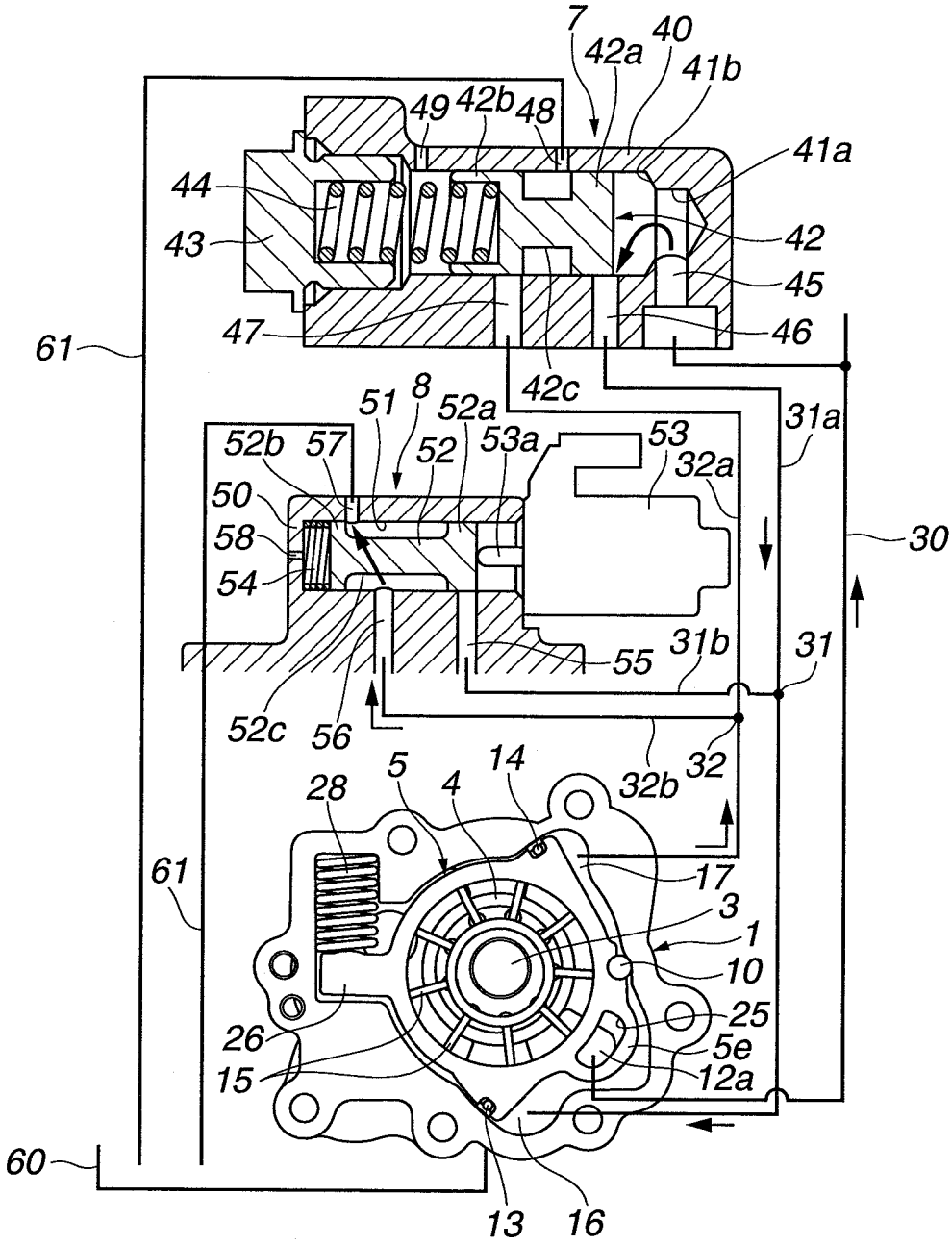
FIG. 10 is an explanatory view for explaining an action of the variable displacement pump in the first embodiment at a time of a common use revolution of the engine of the variable displacement pump in the first embodiment.

When the hydraulic pressure is introduced to hydraulic pressure introduction port 45 and is increased to $P_k$ in FIG. 12, first spool valve 42 is moved in a backward direction by a predetermined distance against the spring force of first valve spring 44, as shown in FIG. 10. This causes hydraulic pressure introduction port 45 to be communicated with first pilot control port 46 and the communication between first pilot control port 46 and first drain port 48 is interrupted. In addition, a closure state of second pilot control port 47 is maintained by means of second valve body 42*b*.

In this second state, the hydraulic pressure in hydraulic pressure introduction port 45 indicates Pf shown in FIG. 12 as will be described later. In addition, spring load and spring constant of first valve spring 44, a length of first spool valve 42 and a formation position of each port 46 through 48 are set to enable a transfer to a third state.

(Third State)

Figure 11:
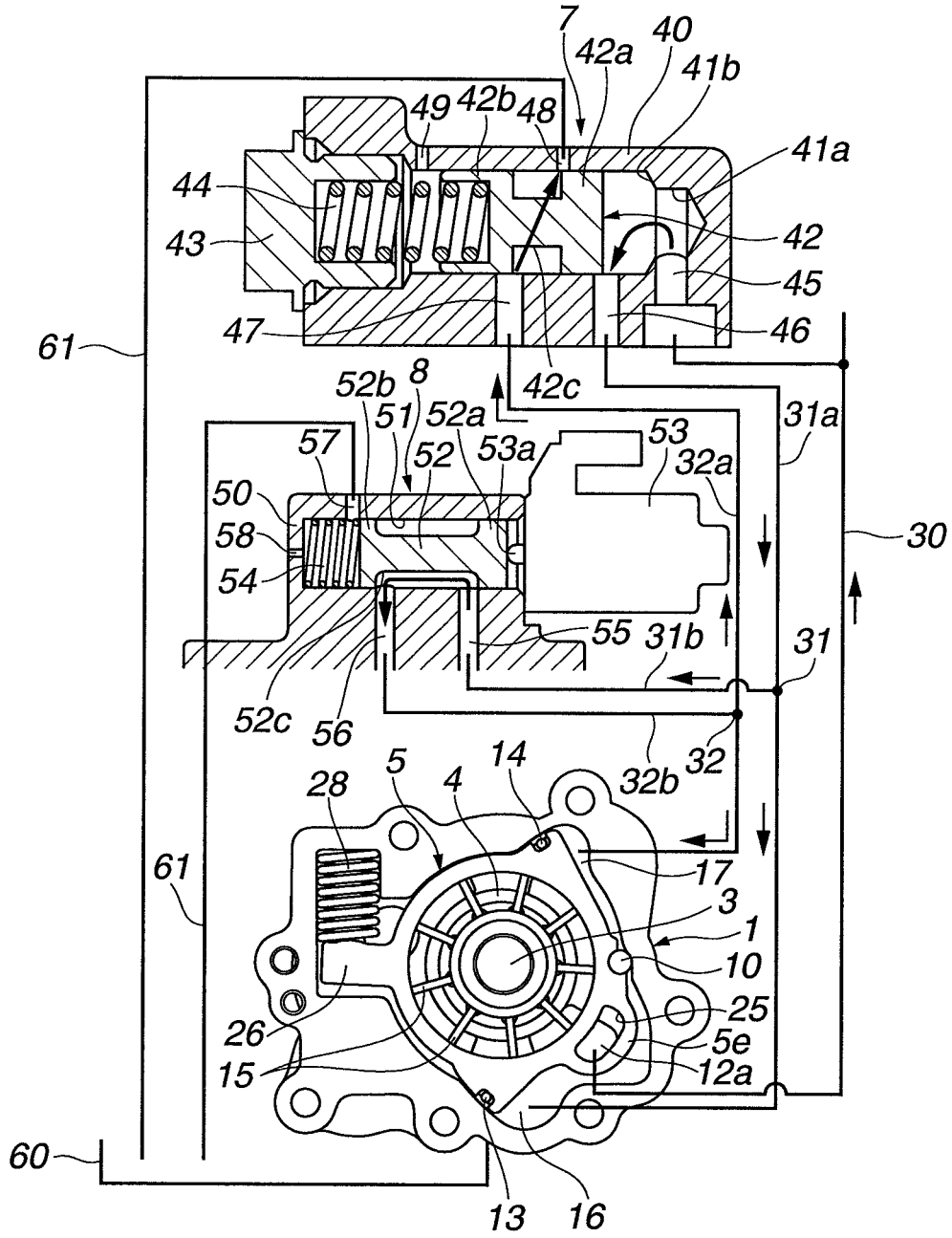
FIG. 11 is an explanatory view for explaining an action of the variable displacement pump in the first embodiment at a time of a high revolution of the engine of the variable displacement pump in the first embodiment.

When the hydraulic pressure introduced to hydraulic pressure introduction port 45 is further increased to $P_s$ in FIG. 12 as will be described later, first spool valve 42 is moved in the backward direction maximally against the spring force of first valve spring 44, as shown in FIG. 11. Thus, the communication state between hydraulic pressure is introduction port 45 and first pilot control port 46 is maintained and the communication between second pilot control port 47 and first drain port 48 via first circular groove 42*c* is started.

Figure 8:
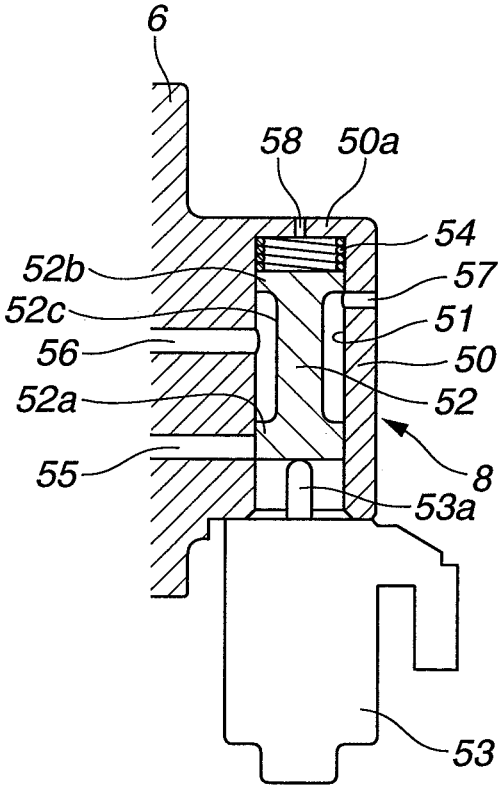
FIG. 8 is a longitudinal cross sectional view of an electromagnetic switching valve of the variable displacement pump in the first embodiment shown in FIG. 1.

Electromagnetic switching valve 8, as shown in FIGS. 1 and 8, includes: a second valve body 50 in a lidded cylindrical shape in which an upper part thereof is closed, second valve body 50 being integrally formed in a vertical direction thereof on other side section of control housing 6; a second spool valve 52 which is vertically slidable within a second valve hole 51 formed at an inside of second valve body 50; a solenoid section 53 installed at a lower end section of second valve hole 51; and a second valve spring 54 elastically interposed between an inner surface of upper wall 50*a* of second valve body 50 and an upper end surface of second spool valve 52 to bias second spool valve 52 in a direction toward solenoid section 53.

A first solenoid control port 55 which is a second discharge port to communicate the tip section of first solenoid oil groove 31*b* with second valve hole 51 is penetrated (in second valve body 50) through a lower end section of a side wall of control housing 6. At an upper position than first solenoid control port 55, a second solenoid control port 56 which communicates the tip section of second solenoid oil groove 32*b* and second valve hole 51 is penetrated in parallel to first solenoid control port 55. A passage cross sectional area of each of first solenoid control port 55 and second solenoid control port 56 is set to be relatively small to form a fixed aperture (orifice) so that a flow resistance is given to oil flowing through of each of both ports 55, 56.

Furthermore, a small-diameter second drain port 57 is penetrated at a substantially upper position of second valve body 50 and a small-diameter breathing hole 58 opened to the atmosphere is penetrated at a substantial center section of an upper wall 50*a* of second valve body 50. This breathing hole 58 serves to secure the sliding characteristic of second spool valve 52 and is formed at the position which is higher than first and second control oil chambers 16, 17 so as to suppress the flowing in of air into respective control oil chambers 16, 17. Second drain port 57 is communicated with oil pan 60 via drain passage 61.

First valve body 52*a* and second valve body 52*b* are formed to vary an opening area of each port 55 through 57 in accordance with a slide position of these valve bodies at upper and lower positions of second spool valve 52 with second circular groove 52*c* formed at the substantial center position of the outer peripheral surface in the axis direction of second valve body 50. This second spool valve 52 biases a push rod 53*a* of solenoid section 53 toward a maximum lower position according to the spring force of second valve spring 54 while pressing push rod 53*a* in the downward direction. Thus, first solenoid control port 55 is communicated with second solenoid control port 56 via second circular groove 52*c*.

As shown in FIG. 1, solenoid section 53 is coupled to second valve body 50 by means of a bolt 59 via a bracket 53*b* installed on an upper end outer periphery and an electromagnetic coil, a stationary iron core, and a slidably movable iron core are housed in the inside of solenoid section 53. Push rod 53*a* is coupled to a tip section of the movable iron core described above.

(Basic Operation of Electromagnetic Switching Valve)

Hence, when a control current is supplied from an electronic controller not shown to the electromagnetic coil of solenoid section 53, the stationary iron core is excited so that, as shown in FIG. 8 through FIG. 10, push rod 53*a* slides second spool valve 52 in the maximum upper position against the spring force of second valve spring 54. Therefore, first valve body 52*a* closes the opening end of first solenoid control port 55 to interrupt the communication with second solenoid control port 56 and second solenoid control port 56 and second drain port 57 are communicated with each other via second circular groove 52*c*.

In addition, when the supply of control current to the electromagnetic coil of solenoid section 53 is interrupted, as shown in FIG. 11, second spool valve 52 is moved in a maximum rightward position (a maximum lower position) according to the spring force of second valve spring 54. Thus, first solenoid control port 55 and second solenoid control port 56 are communicated with each other via second circular groove 52*c*.

Then, the discharge pressure from discharge port 12 is switchably introduced into first control oil chamber 16 and second control oil chamber 17 by means of pilot valve 7 and electromagnetic switching valve 8. In a case where the discharge pressure is acted upon only first control oil chamber 16, the pressure is acted upon a first pressure receiving surface 20 of cam ring 5 in the direction toward which the eccentricity of cam ring 5 is decreased. When this pressure becomes larger than spring load W of coil spring 28, cam ring 5 starts a swing motion in the clockwise direction in FIG. 2 with pivot pin 10 as a center.

In addition, in a case where the discharge pressure is acted upon second control oil chamber 17 in addition to first control oil chamber 16, the pressure is acted upon a second pressure receiving surface 21 of cam ring 5 in the direction toward which the eccentricity of cam ring 5 is increased. However, since a distance from pivot pin 10 to each of seal surfaces 1*a*, 1*b* has such a relationship as R1>R2 (refer to FIG. 2) and the area of first pressure receiving surface 20 is larger than that of second pressure receiving surface 21. Hence, when the discharge pressure of first control oil chamber 16 becomes larger than spring load W of coil spring 28, cam ring 5 starts the swing motion in the clockwise direction with pivot pin 10 as a center. The hydraulic pressure at this time becomes larger than a case where the discharge pressure is acted only upon first control oil chamber 16.

Hence, two kinds of working pressure (a high working pressure and a low working pressure) characteristics can be obtained according to the switching of the presence or absence of the introduction of the discharge pressure to second control oil chamber 17.

[Required Hydraulic Pressure of the Engine which Provides a Reference of a Discharge Pressure Control of the Variable Displacement Pump]

First, before entering an explanation of action of the variable displacement pump, the required hydraulic pressure of the internal combustion engine which provides the reference to the discharge pressure control of the variable displacement pump will be described on a basis of FIG. 12.

P1 in FIG. 12 denotes a first required hydraulic pressure corresponding to the required hydraulic pressure of the valve timing control apparatus, P2 in FIG. 12 denotes a second required hydraulic pressure in a case where an oil jet to cool a piston of the engine is used, and P3 denotes a third required hydraulic pressure required for a lubrication of a journal section of the engine crankshaft when the engine speed is high. A dot-and-dash line E in FIG. 12 which links these three points of P1 through P3 represents an ideal required hydraulic pressure (discharge pressure) P in accordance with the engine speed of the internal combustion engine.

It should be noted that a solid line in FIG. 12 denotes a hydraulic pressure characteristic according to the variable displacement pump in the first embodiment and a broken line in FIG. 12 denotes the hydraulic pressure characteristic of a comparative example of the variable displacement pump described in the

BACKGROUND OF THE INVENTION.

It should also be noted that Pf in FIG. 12 denotes the working hydraulic pressure in a low working pressure state, for example, at a time of the engine start, $P_s$ in FIG. 12 denotes the working pressure in the high working pressure state at the time of engine high speed revolution area, and Pt in FIG. 12 denotes an arrival hydraulic pressure when switched to the high working pressure side when a predetermined engine speed, a predetermined engine oil temperature, and a predetermined engine load occurs.

In the comparative example of the variable displacement pump, the eccentricity of the cam ring even after the hydraulic pressure has reached to hydraulic pressure Pf to suppress the rises of discharge quantity and discharge pressure along with the rise in the engine speed (pump revolution speed). However, the discharge pressure is rapidly raised due to an influence of the spring constant of the coil spring acted upon the cam ring. This state is the same after the high working pressure is switched and the hydraulic pressure has reached to $P_s$.

On the other hand, in a case of the variable displacement pump in the first embodiment, the spring load of first valve spring 44 of pilot valve 7 is set according to the relationship between the movement of first spool valve 42 and pump discharge pressure from discharge port 12, as described above. Spring load W of coil spring 28 and the dimension of the volume of each of first and second control oil chambers 16, 17 are set such that the working pressure in a state in which the discharge pressure is not acted upon second control oil chamber 17 is smaller than $P_k$ but working pressure $P_u$ (not shown) in a state ion which the discharge pressure is acted upon second control oil chamber 17. Specific action and effect will be described below.

[Specific Action of the Variable Displacement Pump in the First Embodiment]

At an interval of (a) in FIG. 12 corresponding to the interval from the start of the engine to the low (engine) revolution area, discharge pressure P (hydraulic pressure within the engine) is smaller than $P_k$. Hence, as shown in FIG. 9, first spool valve 42 of pilot valve 7 is pressed against a step section 41*b* of first valve hole 41 at the rightmost position in FIG. 9 according to the spring force of first valve spring 44. This causes first valve body 42*a* to close hydraulic pressure introduction port 45 and first pilot control port 46 and first drain port 48 are communicated via first circular groove 42*c*.

On the other hand, electromagnetic switching valve 8 receives the control current from the electronic controller at the electromagnetic coil thereof so that second spool valve 52 moves toward the maximum left direction against the spring force of second valve spring 54. This causes first valve body 52*a* to close first solenoid control port 55 and second solenoid control port 56 and second drain port 57 are communicated with each other via second circular groove 52*c*.

Hence, first control oil chamber 16 is communicated with drain passage 61 via pilot valve 7. Thus, no hydraulic pressure is introduced into the inside of first control oil chamber 16. On the other hand, since second control oil chamber 17 is communicated with second drain port 57 via electromagnetic switching valve 8, no hydraulic pressure is supplied into the inside of second control oil chamber 17.

Hence, cam ring 5 is held at a maximum eccentric state with tip section 26*b* of arm 26 contacted on limitation surface 29 according to the biasing force due to spring load W of coil spring 28. Consequently, the discharge quantity of the pump becomes maximum and discharge pressure P is raised in a substantially proportionally along with the rise in the engine speed.

Thereafter, when the engine speed is furthermore raised and discharge pressure P has reached to $P_k$ (shown in FIG. 12), as shown in FIG. 10, the hydraulic pressure of pilot valve 7 at hydraulic pressure introduction port 45 becomes high. Thus, first spool valve 42 is moved toward the leftward direction as viewed from FIG. 10 by a predetermined length so that the communication between first pilot control port 47 and first drain port 48 is interrupted. In addition, hydraulic pressure introduction port 45 and first pilot control port 46 are communicated with each other. Therefore, discharge pressure P is introduced to first control oil chamber 16. In addition, second pilot control port 47 is continuously closed by means of second valve body 42*b*.

At this time, the supply of control current to electromagnetic switching valve 8 is continued so that first solenoid control port 55 of second spool valve 52 is closed and the communication between second solenoid control port 56 and second drain port 57 is held. At the present time point, oil is not yet introduced to second control oil chamber 17.

As described before, the communication between hydraulic pressure introduction port 45 and first pilot control port 46 is started. However, when the low discharge pressure at this time point indicates $P_k$, the opening area of first pilot spool valve 42*a* is small and oil is introduced to first control oil chamber 16 in a pressure decreased state. Spring load W of coil spring 28 is set such that cam ring 5 is swung with a smaller hydraulic pressure than hydraulic pressure $P_k$, as described above. Hence, pilot valve 7 is pressure regulated so that the hydraulic pressure of first control oil chamber 16 is not raised to $P_k$.

The pressure regulation of first control oil chamber 16 is carried out by the variation in the opening area at the initial stage at which first pilot control port 46 of pilot valve 7 is started to open. Hence, no influence of the spring constant of coil spring 28 is received.

Then, since, as described before, the pressure regulation of first control oil chamber 16 is carried out in a short stroke range of first spool valve 42 of pilot valve 7, a useless increase in discharge pressure P based on the rise in the engine speed is suppressed without influence of the spring constant of first valve spring 44 (interval of (b) in FIG. 12).

In addition, as described hereinabove, in a case where air is mixed into oil, a hydraulic pressure equilibrium of inside and outside of cam ring 5 is lost and the variation in the hydraulic pressure due to a motion variation of cam ring 5 can be suppressed.

Discharge pressure P at interval of (b) in FIG. 12 is not proportionally increased on a basis of the rise in the engine speed as in the case of the variable displacement pump in the comparative example denoted by the broken line in FIG. 12 but provides a substantially flat characteristic so that the discharge hydraulic pressure can be made approach to the ideal required hydraulic pressure (a dot-and-dash line in FIG. 12) as nearly as possible. Therefore, in the variable capacity pump according to the first preferred embodiment, as compared with the characteristic of the variable displacement pump in the comparative example (broken line in FIG. 12) in which the increase in discharge pressure P is compelled by the spring constant of coil spring 28 along with the rise in the engine speed, it is possible to reduce a power loss (a hatching range E1 in FIG. 12) generated due to the increase in a wasteful increase in discharge pressure P.

In addition, in a case where the engine speed is further increased and it becomes necessary for discharge pressure P to be equal to or larger than P2 which is the required hydraulic pressure of the oil jet described above, the supply of the control current to electromagnetic switching valve 8 is interrupted. At this time, second spool valve 52 moves toward the maximum rightward direction according to the spring force of second valve spring 54 as shown in FIG. 11 so that first solenoid control port 55 and second solenoid control port 56 are communicated with each other and second drain port 57 is closed. Thus, the discharge pressure is introduced to second control oil chamber 17. Accordingly, cam ring 5 is swung in the direction toward which the eccentricity is increased to increase discharge pressure and to increase the discharge quantity.

On the other hand, first spool valve 42 of pilot valve 7 is moved toward a more leftward direction than the position shown in FIG. 10 so that hydraulic pressure introduction port 45 and first pilot control port 46 are communicated with each other with sufficient opening areas. Therefore, both of first control oil chamber 16 and second control oil chamber 17 indicate substantially equal discharge pressures. Consequently, both oil chambers 16 and 17 are in the high working pressure states.

However, hydraulic pressure $P_s$ which provides the communication state between second pilot control port 47 and first drain port 48 through pilot valve 7 is set to be lower than high working pressure $P_u$ at which the hydraulic pressure is supplied to first control oil chamber 16 and second control oil chamber 17 and the swing motion of cam ring 5 is started against spring load W of coil spring 28. Hence, the discharge pressure does not reach to high working pressure $P_u$ and at the time point at which the discharge pressure reaches hydraulic pressure of $P_s$, second control oil chamber 17 starts the communication with first drain port 48 (drain passage 61).

During an oil passage from electromagnetic switching valve 8 to second control oil chamber 17, namely, when oil is caused to flow through first and second solenoid control ports 55, 56, a flow resistance is generated to give a pressure loss. Thus, oil is drained from pilot valve 7 so that the hydraulic pressure of second control oil chamber 17 is regulated to be reduced than the discharge pressure.

That is to say, as shown in FIG. 11, part of oil passed from hydraulic pressure introduction port 45 of pilot valve 7 to first pilot control port 46 is supplied to first control oil chamber 16 but the other part of oil is caused to flow from first solenoid control port 55 to second solenoid control port 56 via second circular groove 52*c*. At this flow of oil, the flow resistance is given.

In addition, oil passed through second solenoid control port 56 is branched into second control oil chamber 17 and pilot valve 7 side. Oil branched toward pilot valve 7 side is caused to flow from second pilot control port 47 into first circular groove 42*c* and is exhausted from first drain port 47 to drain passage 61. When oil is caused to flow from second pilot control port 47 to first circular groove 42*c*, the opening area is throttled at an end edge of second valve body 42*b* of first spool valve 42 so that a drain quantity is regulated. Hence, the hydraulic pressure of second control oil chamber 17 is regulated to be reduced than the discharge pressure.

The pressure regulation of second control oil chamber 17 is carried out according to the variation of the opening area at the initial stage at which the opening of second pilot control port 47 of pilot valve 7 is started by means of second valve body 42*b*. Hence, no influence of the spring constant of coil spring 28 is given. As described above, the pressure regulation is carried out in a short stroke range of first spool valve 42 of pilot valve 7. Thus, without influence of the spring constant of first valve spring 44, an useless increase in discharge pressure P based on the rise in the engine speed can be suppressed (an interval of © in FIG. 12). A power loss generated due to a wasteful increase in discharge pressure P (a hatching line E2 in FIG. 12) can be suppressed at a minimum.

In addition, electromagnetic switching valve 8 supplies the hydraulic pressure to communicated second control oil chamber 17 to provide a high hydraulic oil side characteristic at the time of no supply of the control current. When an abnormality such as a broken wire occurs, the discharge pressure in the pump rotation region equal to or higher than a middle speed can secure P2, P3 shown in FIG. 12 so as to exhibit a failsafe function.

As described hereinabove, in the first embodiment, a wasteful rise in the hydraulic pressure supplied to first and second control oil chambers 16, 17 can be suppressed according to a cooperative control of pilot valve 7 and electromagnetic switching valve 8. Hence, a reduction in a fuel consumption at an ordinary use revolution area of the engine and an improvement in the output of engine at the time of the high engine speed can be achieved.

In addition, in the first embodiment, pilot valve 7 and electromagnetic switching valve 8 are integrally installed on a back surface of pump cover 2 via control housing 6. Hence, a small sizing of the whole pump can be achieved.

In addition, each pilot oil groove 31*a*, 31*b* and each solenoid oil groove 32*a*, 32*b* are disposed on the outside surface of pump cover 2. As compared with a case where these grooves are separately and independently in a piping structure, a manufacturing work becomes easy, an assemble work becomes easy, and an increase of a manufacturing cost can be suppressed.

Although, in the first embodiment, control housing 6 and pump cover 2 are separately formed to form oil grooves 31*a* through 32*b* on the outside surface of pump cover 2, it is possible to form passage corresponding to these oil grooves through a hole drilling with these control housing 6 and pump cover 2 integrated with each other.

Furthermore, it is possible to install an oil filter at a downstream side of hydraulic pressure introduction port 45 to suppress an invasion of a contamination within pilot valve 7 and electromagnetic switching valve 8.

Second Preferred Embodiment

Figure 13:
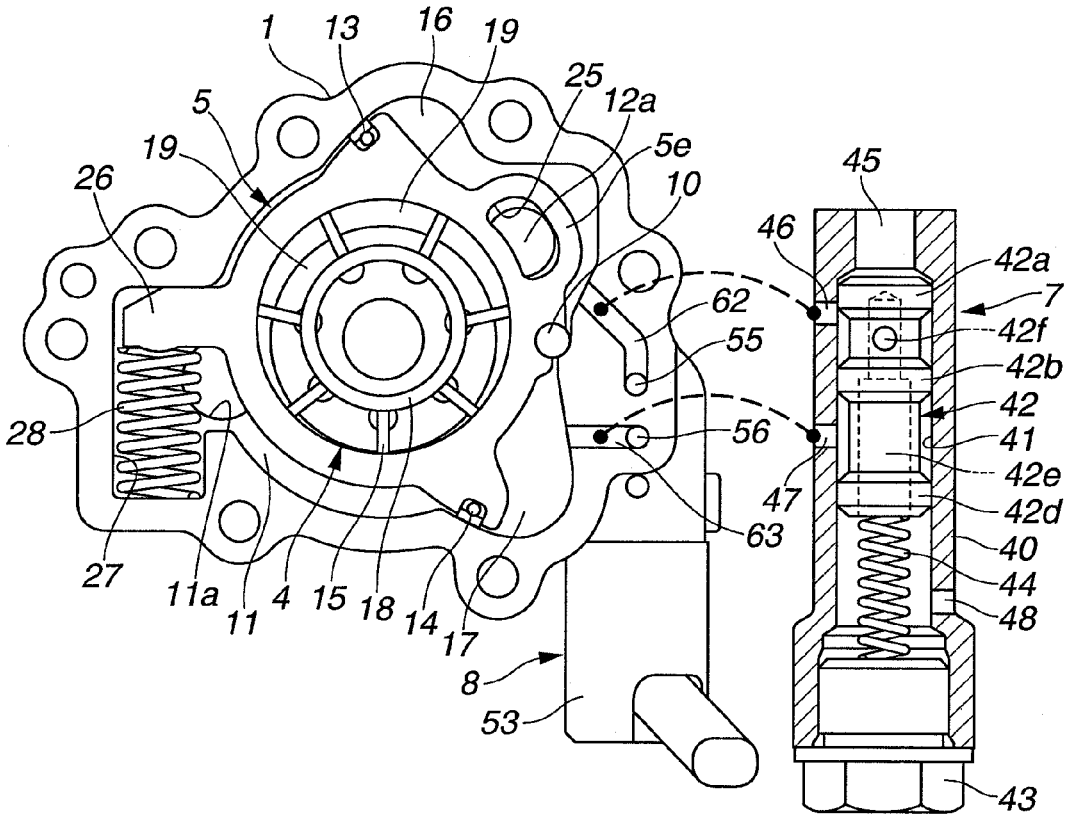
FIG. 13 is a longitudinal cross sectional view of the pilot valve of the variable displacement pump in a second preferred embodiment according to the present invention while representing a main part of the variable displacement pump in the second embodiment.

FIG. 13 shows a second preferred embodiment according to the present invention. A basic structure of the pump main body of the variable displacement pump in this embodiment is substantially the same as the structure of the first embodiment. In view of FIG. 13, the variable displacement pump is arranged in an inverted configuration. In addition, pilot valve 7 is integrally installed at pump cover 2 side but electromagnetic switching valve 8 is integrally installed at pump housing 1. The same reference numerals in the second embodiment as those in the first embodiment designate like elements in the second embodiment.

That is to say, pilot valve 7, as shown in FIG. 13, mainly includes: cylindrical first valve body 40; first spool valve 42 slidably mounted within first valve hole 41; and first valve spring 44 elastically interposed between plug 43 and first spool valve 42.

First spool valve 42 includes: first valve body 42*a* installed at the forward end side of first spool valve 42 arranged to vary the opening area of hydraulic pressure introduction port 45; second valve body 42*b* installed at the substantial center side of first spool valve 42 and arranged to vary the opening area of second pilot control port 47; a land section 42*d* installed at the back end side of first spool valve 42. In addition, a passage hole 42*e* is formed in an inner axis direction of a valve axle of first spool valve 42. One end of passage hole 42*e* facing first valve body 42*a* is closed and the other end of passage hole 42*e* facing first drain port 48 is opened. Furthermore, a communication hole 42*f* which communicates with passage hole 42*e* is penetrated along the radial direction of first spool valve 42. Communication hole 42*f* is interposed between first valve body 42*a* and second valve body 42*b* in the valve axle direction.

The upper end opening of first valve body 40 constitutes hydraulic pressure introduction port 45. First pilot control port 46 and second pilot control port 47 are penetrated through upper and lower positions at the upper part of the peripheral wall of first valve body 40. Furthermore, first drain port 48 is penetrated at the lower side of the peripheral wall of first valve body 40. This drain port 48 also serves as the breathing hole. Hence, one port can be reduced.

Hydraulic pressure introduction port 45 is communicated with the oil main gallery via a filter not shown and first pilot control port 46 is communicated with first control oil chamber 16 via a first oil groove 62 formed on a front surface of pump housing 1 on which pump cover 2 is contacted. In addition, second pilot control port 47 is communicated with second control oil chamber 17 via a second oil groove 63 formed on the front surface of pump housing 1.

Figure 14A:
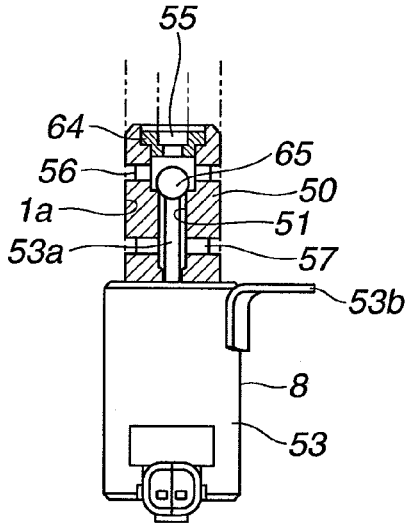
FIGS. 14A and 14B are partially cross sectional views of the electromagnetic switching valve in the second embodiment when the valve is open and when the valve is closed, respectively.
Figure 14B:
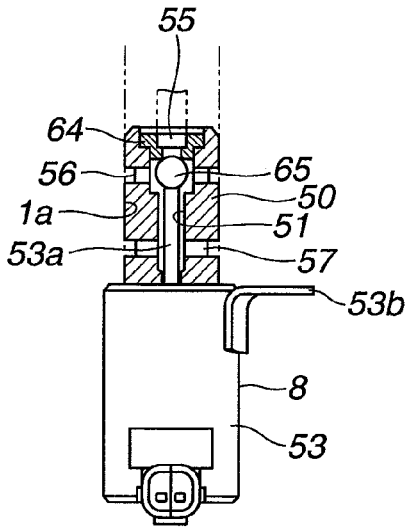

Electromagnetic switching valve 8, as shown in FIGS. 14A and 14B, includes: second valve body 50 forcibly inserted into valve housing hole 1*a* formed at the predetermined position of pump housing 1 and having a working hole 51 in an inner axis direction of second valve body 50; a valve seat 64 forcibly inserted into the tip section of working hole 51 and at the center of which first solenoid control port 55 is formed; a metallic ball valve 65 which opens and closes the opening end of first solenoid control port 55; and solenoid section 53 installed at one end section of valve body 50.

Second valve body 50 includes second solenoid control port 56 communicated with working hole 51 and penetrated through the peripheral wall of second valve body 50 in the radial direction of second valve body 50 at the upper end section of the peripheral wall; and second drain port 57 penetrated through the radial direction and communicated with working hole 51.

First solenoid control port 55 is communicated with first control oil chamber 16 via first oil groove 62 formed on pump housing 1 and second solenoid control port 56 is communicated with second control oil chamber 17 via second oil groove 63.

The basic structure of solenoid section 53 is the same as the first embodiment. In the inside of the casing, the electromagnetic coil, stationary iron core, the movable iron core, and so forth are housed. Push rod 53*a* is disposed at the tip section of movable iron core. In addition, a second valve spring 54 which biases push rod 53*a* in the reverse direction (namely, a retreat direction at which is far way from ball valve 65). Then, when the control current is supplied from the electronic controller to the electromagnetic coil, as shown in FIG. 14B, push rod 53*a* is moved in the forward direction so that the tip section of push rod 53*a* presses ball valve 65 under pressure to seat ball valve on valve seat 64 so that first solenoid control port 55 is closed. Then, both of second solenoid control port 56 and second drain port 57 are communicated via working hole 51.

On the other hand, when the supply of control current to the electromagnetic coil is interrupted, as shown in FIG. 14A, push rod 53*a* is moved in the retracted (backward) direction and the push (closure) of ball valve 65 is released and first solenoid control port 55 is opened so that both of first solenoid control port 55 and second solenoid control port 56 are communicated within working hole 51 and the communication between second solenoid control port 56 and second drain port 57 is, thus, interrupted.

It should be noted that the other structures, the settings of the spring loads and the working pressure of coil spring 28 and first and second valve springs 44 are the same as those described in the first embodiment.

[Action of the Variable Displacement Pump in the Second Embodiment]

Figures 15A, 15B, 15C:
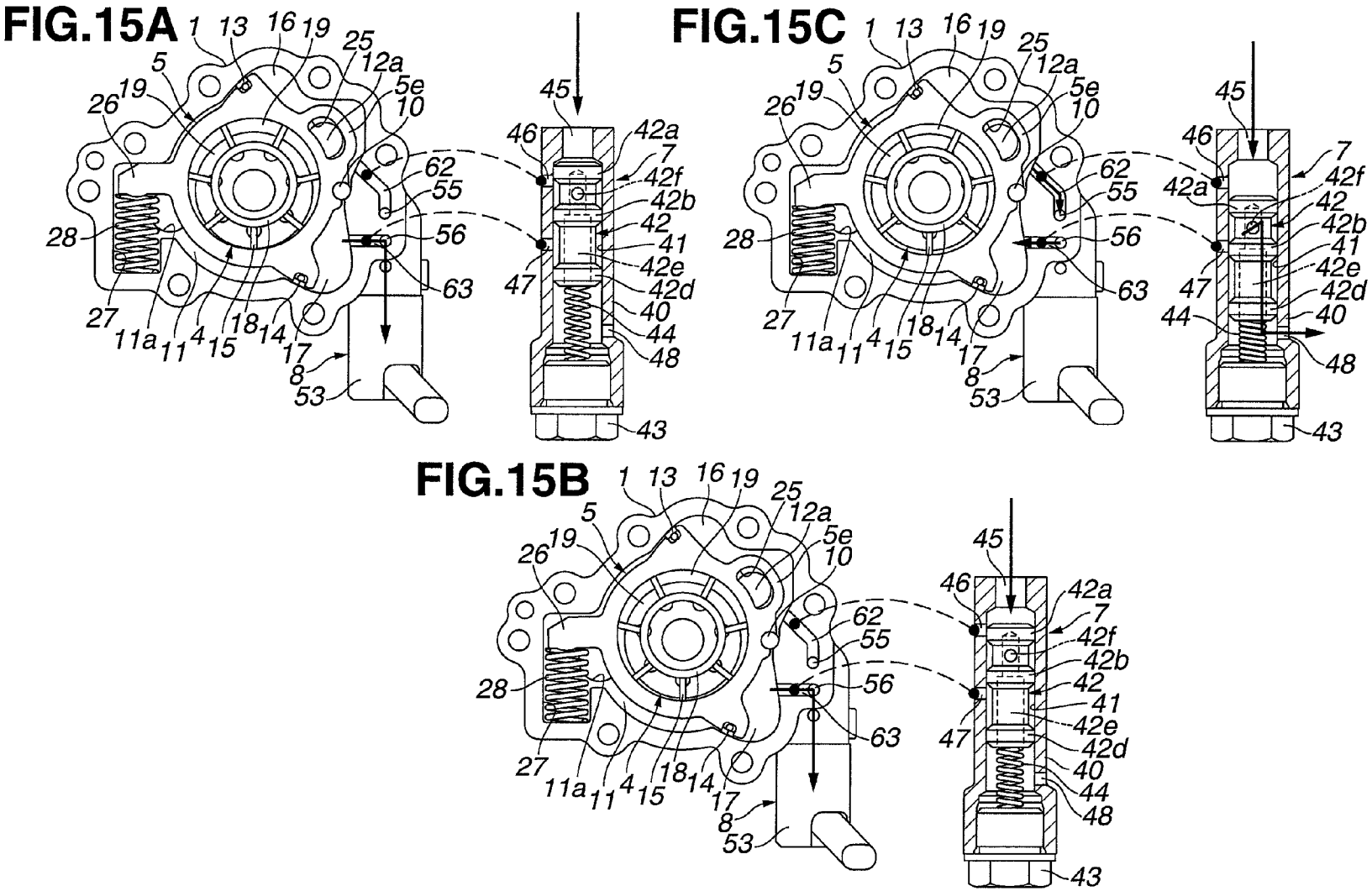
FIGS. 15A, 15B, and 15C are explanatory views for explaining the actions of the variable displacement pump in the second embodiment at the initial stage of the is engine start (15A), at the common use revolution stage of the engine (15B), and at the time of the high engine speed.

During the engine start and when the engine speed is in the low revolution area (an interval of (a) in FIG. 12), the pump discharge pressure is low. Thus, as shown in FIG. 15A, the working hydraulic pressure is acted upon hydraulic pressure introduction port 45 of pilot valve 7 but first spool valve 42 cannot move in the backward direction (lower direction as viewed from FIG. 15A) against the spring force of first valve spring 44. Hence, hydraulic pressure introduction port 45 is not communicated with other ports and oil is not caused to flow into first pilot control port 46. On the other hand, electromagnetic switching valve 8 is in the state in which the control current is supplied to the electromagnetic coil. As shown in FIG. 14B, push rod 53*a* presses ball valve 65 under pressure so that second solenoid control port 56 is communicated with second drain port 57 and first solenoid control port 55 is closed. Hence, the hydraulic pressure is not supplied to first nor second control oil chamber 16, 17. Cam ring 5 is retained at a maximum position at which the eccentricity becomes maximum according to the spring force of coil spring 28. Thus, the pump discharge pressure indicates the solid line characteristic at the interval of (a) in FIG. 12.

When the engine speed is raised and the discharge pressure has reached to the predetermined discharge pressure, the phase becomes the interval of (b) in FIG. 12. First spool valve 42 of pilot valve 7 moves slightly toward the retreated direction (backward direction) against the spring force of first valve spring 44 to open hydraulic pressure introduction port 45 and the opening area of first pilot control port 46 is slightly made larger so that both of ports 45, 46 are started to be communicated with each other. It should be noted that, in this state, the opening area of second pilot control port 46 is small, the pressure loss is developed when oil is caused to flow through second pilot control port 46 and the regulated hydraulic pressure is supplied to first control oil chamber 16.

In this way, since the hydraulic pressure within first control oil chamber 16 is raised, cam ring 5 is swung in the direction toward which the eccentricity of cam ring 5 becomes small against the spring force of coil spring 28, as shown in FIG. 15B so that the pump discharge quantity is reduced and the discharge pressure is slightly reduced. Hence, the pump discharge pressure indicates the characteristic denoted by the solid line at the interval of (b) in FIG. 12.

When the engine speed is furthermore raised and the pump discharge pressure is furthermore raised, the phase indicates the interval of © in FIG. 12. At this time, electromagnetic switching valve 8 interrupts the supply of control current to the electromagnetic coil. Then, as shown in FIG. 14A, push rod 53*a* is moved in the retreat direction (backward direction) according to the spring force of the second valve spring so that ball valve 65 serves to communicate first solenoid control port 55 with second solenoid control port 56 and second drain port 57 is closed. Thus, since oil is supplied to second control oil chamber 17 to raise the hydraulic pressure and cam ring 5 is swung in the direction toward which the eccentricity is increased according to the spring force of coil spring 28 and the hydraulic pressure within second control oil chamber 17 Therefore, the pump discharge quantity is increased to raise the discharge pressure.

On the other hand, pilot valve 7, as shown in FIG. 15C, first spool valve 42 is furthermore moved in the downward direction (the retreat direction) according to the high hydraulic pressure introduced into hydraulic pressure introduction port 45 along with the rise in the discharge pressure so that the opening area of second pilot control port 46 is enlarged maximally and second pilot control port 47 is communicated with communication hole 42*f*. Thus, second pilot control port 47 and first drain port 48 are communicated with each other via passage hole 42*e*. Oil in second control oil chamber 17 is drained through respective ports 47, 42*f*, 42*e*, 48. This hydraulic pressure of second control oil chamber 17 is determined according to the flow resistance due to the orifice effect of each port 55, 56 and the drain quantity. The drain quantity can be regulated according to the opening area of second pilot control port 47 of pilot valve 7. This action can suppress an excessive rise of the pump discharge pressure and the characteristic denoted by the solid line in the interval of © in FIG. 12 can be obtained.

Hence, in the same way as the first embodiment, the wasteful discharge hydraulic pressure of oblique line denoting region E2 in FIG. 12 can be suppressed and the power loss can accordingly be suppressed.

In addition, in the second embodiment, electromagnetic switching valve 8 is installed in pump housing 1 and pilot valve 7 is integrally disposed with pump cover 2. Hence, it becomes unnecessary to form the passage grooves on the pump cover as in the case of the first embodiment. Thus, the control housing becomes unnecessary and a duplex structure of the pump cover becomes unnecessary.

In addition, the valve of electromagnetic switching valve 8 is ball valve 65 in place of the spool valve, the opening area of second solenoid control port 56 can be reduced even in a case where first solenoid control port 55 and second solenoid control port 56 are communicated with each other and the orifice effect to regulate the pressure reducing level with the pressure decreased according to the oil flow quantity.

Third Preferred Embodiment

Figure 16:
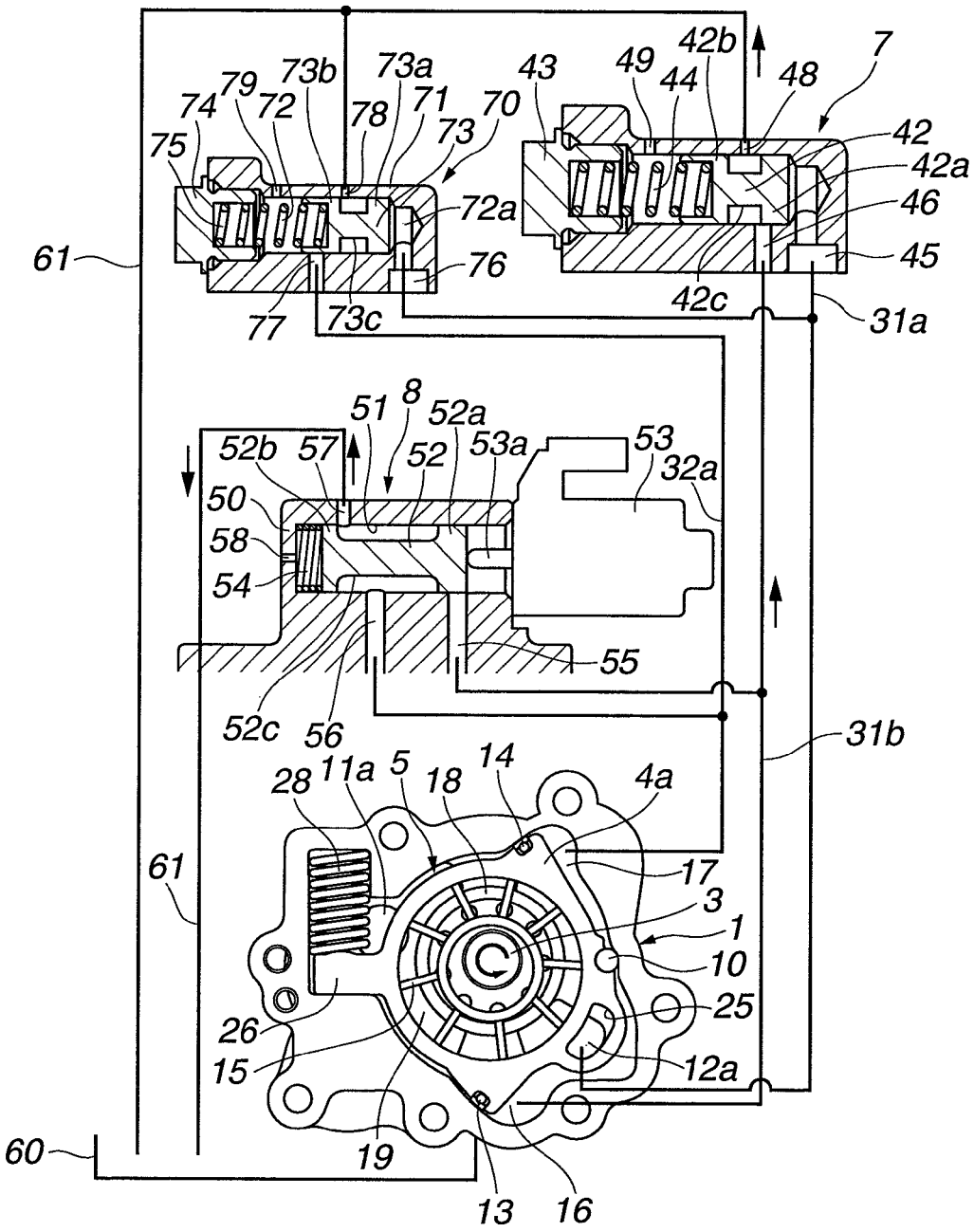
FIG. 16 is an explanatory view for explaining the action of the variable displacement pump in a third preferred embodiment according to the present invention at the time of the initial stage of the engine start.
Figure 17:
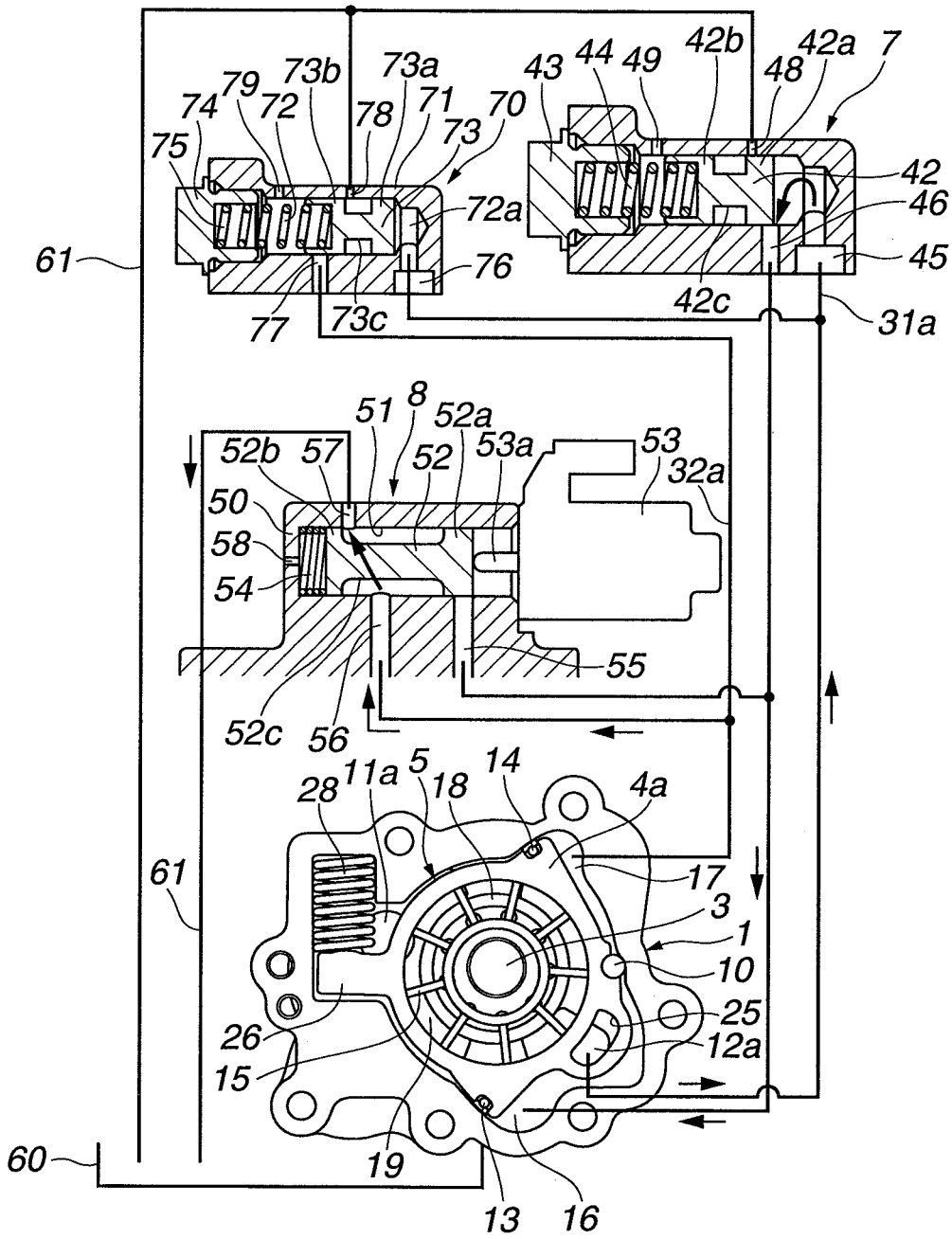
FIG. 17 is an explanatory view for explaining the action of the variable displacement pump at the time of the engine common use revolution in the case of the third embodiment.
Figure 18:
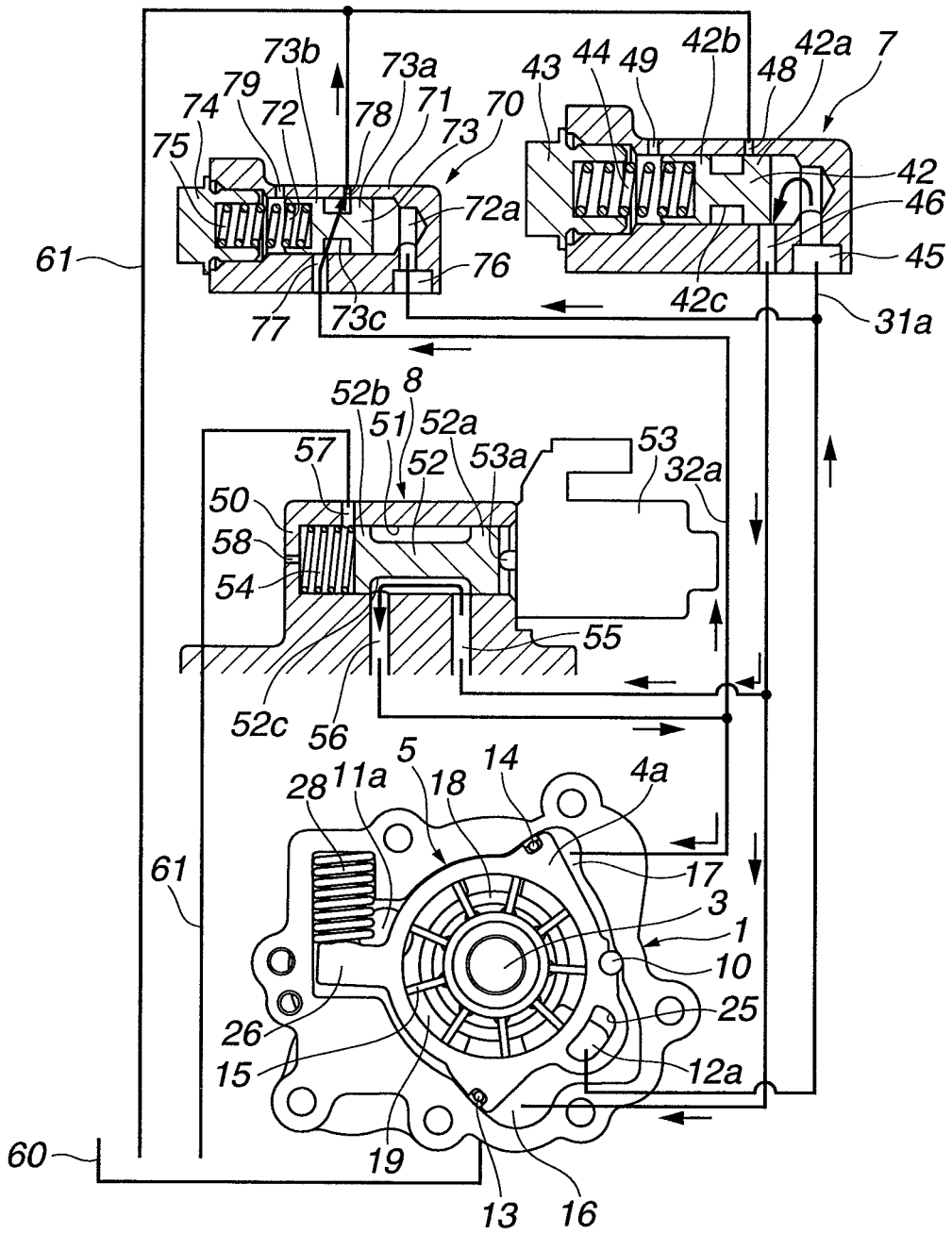
FIG. 18 is another explanatory view for explaining the action of the variable displacement pump in the third embodiment at the time of the high engine speed.

FIGS. 16, 17, and 18 show a third preferred embodiment of the variable displacement pump. In addition to pilot valve 7 and electromagnetic switching valve 8 described in the first embodiment, a second pilot valve 70 which is a second control mechanism is installed.

First, a modifying point on the structure of first pilot valve 7 will be described below. This first pilot valve 7 disuses second pilot control port 47 and the spring load of first valve spring 44 is set to correspond to a relatively low predetermined hydraulic pressure acted upon first hydraulic pressure introducing port 46 under which first valve spring 44 is compressively deformed to move first spool valve 42 in the backward direction.

Second pilot valve 70 has the substantially same structure as first pilot valve 7. Second pilot valve 70 includes: a third valve body 71 in the lidded cylindrical shape having the bottom section closed and installed in the vertical direction in parallel to first pilot valve 7 at the one side section of the outer surface of the control housing (not shown) described above; a third spool valve 73 which is slidably movable in the lateral direction (as viewed from FIG. 16) within a third valve hole 72 formed at the inside of third valve body 71; a plug 74 which closes a left end opening of third valve hole 73 (as viewed from FIG. 16); and a third valve spring 75 which is elastically interposed between plug 74 and third spool valve 73 to bias third spool valve 73 in the rightward direction in FIG. 16.

Second hydraulic pressure introducing port 76 is penetrated through the lower end section of the side peripheral wall of the control housing to communicate discharge pressure introducing hole 30 and small-diameter tip section 72*a* of third valve hole 72. The outside of second hydraulic pressure introducing port 76 is formed in a large-diameter shape and the inside thereof is formed in the small-diameter shape communicated with small-diameter tip section 72*a* from a right angle direction.

Third pilot control port 77 is penetrated through the side section of the peripheral wall of third valve body 71 to communicate second pilot oil groove 32*a* with third valve hole 72. A small-diameter drain port 78 is penetrated through the substantial center position of the peripheral wall of third valve body 71 in the axis direction thereof and a small-diameter breathing hole 79 is penetrated through a leftward position of the peripheral wall as viewed from FIG. 16 in the axis direction thereof to open the air. It should be noted that this breathing hole 79 is provided to secure the smooth sliding characteristic of third spool valve 73 and formed at the position of the peripheral wall higher than first and second control oil chambers 16, 17 so that the flowing in of the air to respective control oil chambers 16, 17 is suppressed.

First valve body 73*a* and second valve body 73*b* are formed at the left and right positions of third spool valve body 73 with a third circular groove 73*c* formed at the substantially center of outer peripheral surface of third spool valve 73 as a center. First valve body 73*a* and second valve body 73*b* serve to communicate or interrupt the communication between third pilot control port 77 and third drain port 78 via third circular groove 73*c* while varying the opening areas between third pilot control port 77 and third circular groove 73*c* and between drain port 73*c* and third circular groove 73*c* in accordance with the slide movement position. Then, this third spool valve 73 is biased according to the spring force of third valve spring 75 in the direction toward which second hydraulic pressure introducing port 76 is closed.

Third valve spring 75 is set to have a larger spring force than the spring force of first valve spring 44. When the discharge hydraulic pressure supplied to second hydraulic pressure introducing port 76 is predetermined high hydraulic pressure, third spool valve 73 is moved in the backward direction (retreated direction, namely, in the leftward direction in FIGS. 16 through 18) to communicate between each port 77, 78.

It should be noted that third drain port 78 is communicated with oil pan 60 via drain passage 61.

[Action of the Variable Displacement Pump in the Third Embodiment]

During the interval of (a) in FIG. 12 which corresponds to the case in which the start of the engine is carried out and the revolution area is low, no hydraulic pressure is introduced to first and second hydraulic pressure introduction ports 45, 76 or the hydraulic pressure thereat is low.

In this case, as shown in FIG. 16, the spring force of each of first and third valve springs 44, 75 causes first and third spool valves 42, 73 to be moved toward tie rightward direction (lower direction) maximally to close the opening end of each hydraulic pressure introduction port 45, 76. At this time, the communication between third pilot control port 77 and third drain port 78 is interrupted by means of second valve body 73*b* of third spool valve 73. However, the communication between first pilot control port 46 of first pilot valve 7 and first drain port 48 thereof is maintained so that first control oil chamber 16 is opened to the air via each port 46, 48 described above.

On the other hand, the electromagnetic coil of electromagnetic switching valve 8, in the same way as the first embodiment, receives the control current from the electronic controller so that second spool valve 52 moves toward the maximum leftward direction against the spring force of second valve spring 54. Thus, first valve body 52*a* causes first solenoid control port 55 to be closed so that second solenoid control port 56 is communicated with second drain port 57 via second circular groove 52*c*.

Thus, first control oil chamber 16 is communicated with drain passage 61 via first pilot valve 7 so that oil is not introduced to the inside of first control oil chamber 16 and second control oil chamber 17 is communicated with second drain port 57 via electromagnetic switching valve 8 and oil is not introduced into the inside of second control oil chamber 17.

Hence, cam ring 5 is held in the maximum eccentricity state with tip section 26*b* of arm 26 contacted on limitation surface 29 according to the biasing force due to spring load W of coil spring 28. Consequently, the discharge quantity of the pump becomes maximum and discharge pressure P is raised in substantially proportionally along with the rise in the engine speed Thereafter, when the engine speed is furthermore raised and discharge pressure P has reached to $P_k$ (shown in FIG. 12), as shown in FIG. 17, the hydraulic pressure of first hydraulic pressure introduction port 45 of first pilot valve 7 becomes high so that first spool valve 42 moves in the leftward direction (as viewed from FIG. 17) by the predetermined length so that first valve body 42*a* enlarges the opening area of first pilot control port 46 and discharge pressure P is introduced into first control oil chamber 16.

At this time, since the hydraulic pressure acted upon second hydraulic pressure introducing port 76 of second pilot valve 70 does not reach to the pressure under which third valve spring 75 is compressively deformed, third spool valve 73 maintains the state in which first pilot control port 77 and third drain port 78 are not communicated.

In addition, at this time point, the supply of control current to electromagnetic switching valve 8 is continued and first solenoid control port 55 of second spool valve 52 is closed so that second solenoid control port 56 is communicated with second drain port 57. Therefore, at this time point, oil is not yet introduced to second control oil chamber 17.

In addition, in a case where the engine speed is furthermore raised and discharge pressure P is required to be equal to or higher than required pressure P2 of the above-described oil jet, the supply of control current to electromagnetic switching valve 8 is interrupted. At this time, as shown in FIG. 18, second spool valve 52 moves the maximum rightward direction by means of the spring force of second valve spring 54 and first solenoid control port 55 and second solenoid control port 56 are communicated and second drain port 57 is closed. Thus, discharge pressure is introduced to second control oil chamber 17 so that cam ring 5 is swung in the direction toward which the eccentricity is increased to increase the discharge quantity and the discharge pressure is increased.

On the other hand, in first spool valve 42 of first pilot valve 7, first hydraulic pressure introduction port 45 and first pilot control port 46 are maintained in a communication state with a sufficient opening area. Therefore, since first control oil chamber 16 and second control oil chamber 17 are substantially equal discharge pressures, both oil chambers 16 and 17 are in highly working pressure states.

However, hydraulic pressure $P_s$ under which first pilot control port 46 and first drain port 48 are communicated with each other by means of first pilot valve 7 is set to be lower than high working pressure $P_u$ under which the hydraulic pressure is supplied to both of first and second control oil chambers 16 and 17 and the swing motion of cam ring 5 is started against spring load W of coil spring 28. Hence, discharge pressure P does not reach to high working pressure $P_u$. At the time point at which the discharge pressure has reached to $P_s$, second pilot valve 70, as shown in FIG. 18, is moved in the backward direction against the spring force of third valve spring 75 along with the rise in the hydraulic pressure of second hydraulic pressure introducing port 76 so that the communication between third pilot control port 77 and third drain port 78 (drain passage 61) is started. This causes second control oil chamber 17 to be in the communication state with drain passage 61.

Then, during the oil passage from electromagnetic switching valve 8 to second control oil chamber 17, namely, when oil is caused to flow through first and second solenoid control ports 55, 56, the flow resistance is developed to generate the pressure loss. Hence, oil is drained from each port 77, 78 of second pilot valve 70 so that the hydraulic pressure of second control oil chamber 17 is regulated to be lower than the discharge pressure at this time.

In other words, as shown in arrow marks in FIG. 18, a part of oil passed from hydraulic pressure introduction port 45 of first pilot valve 7 to first pilot control port 46 is supplied to first control oil chamber 16 but other part of oil is caused to flow from first solenoid control port 55 to second solenoid control port 56 via second circular groove 52. The other part of oil described above receives the flow resistance at this flow.

In addition, oil passed from second solenoid is control port 56 is branched into first control oil chamber 16 and second pilot valve 70 side and oil at second pilot valve 70 side is caused to flow from third pilot control port 77 to third circular groove 73*c* and exhausted from third drain port 78 to drain passage 61. However, when oil is caused to flow from third pilot control port 77 to third circular groove 73*c*, the opening area is throttled at the end edge of second valve body 73*b* of third spool valve 73. Hence, the hydraulic pressure of second control oil chamber 17 is regulated to be lower than the discharge pressure.

The pressure regulation of second control oil chamber 17 is carried out according to the variation in the opening area in the initial state at which the opening of third control port 77 is started. Hence, no influence of the spring constant of coil spring 28 is given.

The pressure regulation of second control oil chamber 17 is carried out in the short stroke range of third spool valve 73 of second pilot valve 70. Hence, an useless increase in discharge pressure P based on the rise in the engine speed can be suppressed (interval of © in FIG. 12) without influence of the spring constant of third valve spring 75. Consequently, the same action and advantages as those in the case of the first embodiment can be achieved in the case of the third embodiment.

Especially, in the third embodiment, since second pilot valve 70 is disposed which is independent of first pilot valve 7 and this second pilot valve 70 controls the hydraulic pressure of second control oil chamber 17, a highly accurate control by means of second pilot valve 70 itself can become possible.

Consequently, the pump discharge hydraulic pressure at the interval of (a) and (b) in FIG. 12, especially at the interval of (c) in FIG. 12 at which the engine speed is high (the pump revolution speed is accordingly high), the pump discharge hydraulic pressure can sufficiently approach to the dot-and-dash line of FIG. 12 and it is possible to sufficiently suppress the generation of the wasteful discharge pressure.

The present invention is not limited to the structure in each of the preferred embodiments. For example, it is possible, for example, to further modify the arrangement of spring housing chambers 27, 21.

In addition, it is possible to arbitrarily set the spring load of coil spring 28 according to a specification of the pump and a dimension of the pump and it is possible to arbitrarily modify a diameter and a length of the coil In addition, the variable displacement pump can be applied to hydraulic pressure equipment or so forth other than the internal combustion engine.

Technical ideas graspable from the respective embodiments will be described below.

(1) A variable displacement pump according to an embodiment comprises a second control mechanism configured to switch between a still another state in which hydraulic oil is introduced to the first control oil chamber from the discharge section and a further another state in which hydraulic oil within the first control oil chamber is exhausted.

(2)In an embodiment of the variable displacement pump the second control mechanism comprises a third biasing member and a third valve body biased by the third biasing member, and the third valve body receives the discharge pressure to move the third valve body against the biasing force of the third biasing member prior to the third biasing member to switch from the further other state in which hydraulic oil is exhausted from the first control oil chamber to the still other state in which hydraulic oil is introduced to the first control oil chamber.

(3) In an embodiment of the variable displacement pump, a switching mechanism is an electromagnetic switching valve which is electrically switchably controlled.

(4) In an embodiment of the variable displacement pump the electromagnetic switching valve switches to the one state in which hydraulic oil is introduced to the second control oil chamber from the discharge section when a revolution speed of the rotor is furthermore increased than that in the still other state in which hydraulic pressure is introduced to the first control oil chamber.

(5) In an embodiment of the variable displacement pump the control mechanism constantly exhausts hydraulic oil within the second control oil chamber and an exhaust quantity of hydraulic oil exhausted at this time is constantly variable after the electromagnetic switching valve switches to the one state in which hydraulic oil is introduced to the second control oil chamber from the discharge section.

(6) In an embodiment of the variable displacement pump, a fixed aperture is disposed between the switching mechanism and the second control oil chamber.

The presence of the fixed aperture causes a flow resistance to be given to hydraulic oil and the pressure decreased hydraulic pressure is supplied to the second control oil chamber.

(7) In an embodiment of the variable displacement pump the control mechanism exhausts hydraulic oil within the first control oil chamber until the discharge pressure indicates a predetermined first pressure, introduces the discharge pressure to first control oil chamber and limits a communication between a drain port and another port than the drain port when the discharge pressure is in excess of the first pressure, and exhausts hydraulic oil within the second control oil chamber while maintaining the introduction of the discharge pressure to the first control oil chamber when the discharge pressure is further raised and exceeds a second pressure.

(8) In an embodiment of the variable displacement pump, the switching mechanism comprises: a valve body having a second discharge port to which the discharge pressure is introduced, a communication port communicated with the second control oil chamber, and a second drain port communicated with a drain passage; and a spool valve body slidably disposed within the valve body to control a communication state of each of the ports, when the spool valve body is in the initial state, the communication between the second discharge port and another port than the second discharge port is limited and the communication port and the second drain port are communicated with each other, and, when the spool valve body is moved, the second discharge port is communicated with the communication port and the communication state between the second drain port and a port other than the second drain port is limited.

(9) In an embodiment of the variable displacement pump the spool valve of the switching mechanism is structured to be moved electrically.

(10) In an embodiment of the variable displacement pump the second discharge port is communicated with a passage branched from a passage communicated between the first control oil chamber or between the first control port and the first control oil chamber.

(11) In an embodiment of the variable displacement pump the communication port is communicated with a passage branched from a passage communicated between the second control oil chamber or between the second control port and the second control oil chamber.

(12) In an embodiment of the variable displacement pump the spool valve of the switching mechanism is switched when the control mechanism is in the second state.

(13) In an embodiment of the variable displacement pump the second discharge port and/or the communication port constitutes the aperture.

(14) In an embodiment of the variable displacement pump the discharge pressure is introduced to one end section of the spool valve of the control mechanism which is not biased by the control spring via a discharge port and the spool valve is moved against the biasing force of the control spring such that the discharge port and the first control port are communicated with each other via the one end section of the spool valve.

(15) In the embodiment of the variable displacement pump the drain port of the control mechanism has a smaller opening area than the aperture.

This application is based on a prior Japanese Patent Application No. 2011-279095 filed in Japan on Dec. 21, 2011. The entire contents of this Japanese Patent Application No. 2011-279095 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A variable displacement pump comprising:

a rotationally driven rotor;

a plurality of vanes provided in an outer periphery of the rotor and arranged to be moved in a radially inward direction and to be moved in a radially outward direction;

a cam ring in an inside of which the rotor and the vanes are housed, in an inner part of which a plurality of pump chambers are formed, and configured to be moved to vary an eccentricity of the cam ring with respect to a rotary center of the rotor;

a housing including:

a suction section formed on at least one side surface of the cam ring and opened to one of the pump chambers whose volume is increased when the cam ring is eccentrically moved toward one direction with respect to the rotary center of the rotor; and a discharge section opened to one of the pump chambers whose volume is decreased when the cam ring is eccentrically moved toward another direction with respect to the rotary center of the rotor;

a biasing member configured to bias the cam ring toward the one direction toward which the eccentricity of the cam ring with respect to the rotary center of the rotor becomes large;

a first control oil chamber configured to move the cam ring toward the other direction against a biasing force of the biasing member when a discharge pressure is introduced into the first control oil chamber;

a second control oil chamber configured to act a hydraulic pressure upon the cam ring by cooperating with the biasing force of the biasing member when hydraulic oil is introduced into the second control oil chamber;

a switching mechanism configured to switch between a first state in which hydraulic oil whose pressure is decreased with respect to a discharge pressure is introduced to the second control oil chamber from the discharge section and a second state in which hydraulic oil is discharged from the second control oil chamber; and a control mechanism configured to discharge hydraulic oil within the second control oil chamber as the discharge pressure becomes larger and to adjust the pressure within the second control oil chamber in a pressure decrease direction when the switching mechanism introduces hydraulic oil whose pressure is decreased with respect to the discharge pressure to the second control oil chamber during a high revolution of the pump.

2. The variable displacement pump as claimed in claim 1, wherein the variable displacement pump further comprises a second control mechanism configured to switch between a third state in which hydraulic oil is introduced to the first control oil chamber from the discharge section and a fourth state in which hydraulic oil within the first control oil chamber is exhausted.

3. The variable displacement pump as claimed in claim 2, wherein the second control mechanism comprises a third biasing member and a third valve body biased by the third biasing member, and the third valve body receives the discharge pressure to move the third valve body against the biasing force of the third biasing member prior to the third biasing member switching from the fourth state in which hydraulic oil is exhausted from the first control oil chamber to the third state in which hydraulic oil is introduced to the first control oil chamber.

4. The variable displacement pump as claimed in claim 1, wherein the switching mechanism is an electromagnetic switching valve which is controlled by electrical switching.

5. The variable displacement pump as claimed in claim 4, wherein the electromagnetic switching valve switches to the first state in which hydraulic oil is introduced to the second control oil chamber from the discharge section when a revolution speed of the rotor is furthermore increased than that in the third state in which hydraulic pressure is introduced to the first control oil chamber.

6. The variable displacement pump as claimed in claim 5, wherein the control mechanism constantly exhausts hydraulic oil within the second control oil chamber and an exhaust quantity of hydraulic oil exhausted at this time is constantly variable after the electromagnetic switching valve switches to the first state in which hydraulic oil is introduced to the second control oil chamber from the discharge section.

7. The variable displacement pump as claimed in claim 1, wherein a fixed aperture is disposed between the switching mechanism and the second control oil chamber.

8. The variable displacement pump as claimed in claim 1, wherein the control mechanism exhausts hydraulic oil within the first control oil chamber until the discharge pressure indicates a predetermined first pressure, introduces the discharge pressure to first control oil chamber and limits a communication between a drain port and another port than the drain port when the discharge pressure is in excess of the first pressure, and exhausts hydraulic oil within the second control oil chamber while maintaining the introduction of the discharge pressure to the first control oil chamber when the discharge pressure is further raised and exceeds a second pressure.

9. A variable displacement pump comprising:

a rotationally driven rotor;

a plurality of vanes provided in an outer periphery of the rotor and arranged to be moved in a radially inward direction and to be moved in a radially outward direction;

a cam ring in an inside of which the rotor and the vanes are housed, in an inner part of which a plurality of pump chambers are formed, and configured to be moved to vary an eccentricity of the cam ring with respect to a rotary center of the rotor;

a housing including:

a suction section formed on at least one side surface of the cam ring and opened to one of the pump chambers whose volume is increased when the cam ring is eccentrically moved toward one direction with respect to the rotary center of the rotor; and a discharge section opened to one of the pump chambers whose volume is decreased when the cam ring is eccentrically moved toward another direction with respect to the rotary center of the rotor;

a biasing member configured to bias the cam ring in a state in which a spring load is given to the biasing member such that the eccentricity of the cam ring with respect to the rotary center of the rotor becomes large;

a first control oil chamber configured to move the cam ring toward the other direction against a biasing force of the biasing member when a discharge pressure is introduced into the first control oil chamber;

a second control oil chamber configured to act a hydraulic pressure upon the cam ring by cooperating with the biasing force of the biasing member when hydraulic oil is introduced into the second control oil chamber;

a switching mechanism configured to switch between one state in which hydraulic oil is introduced from the discharge section to the second control oil chamber via an aperture to another state in which hydraulic oil within the second control oil chamber is exhausted; and a control mechanism including: a valve body having an introduction port to which the discharge pressure is introduced, a first control port communicated with the first control oil chamber, a second control port communicated with the second control oil chamber, and a drain port communicated with a drain passage; a spool valve slidably disposed within the valve body to control a communication state of each of the ports; and a control spring which biases the spool valve with a biasing force smaller than that of the biasing member, wherein the spool valve receives the discharge pressure to slide within the valve body against a biasing force of the control spring, at an initial position at which the spool valve is biased by, the control spring to move maximally, a communication state between the introduction port and the second control port and another port than the introduction port and second control port is limited and a first state in which the first control port and the drain port are communicated with each other occurs, and, when the discharge pressure is increased, the second control port is communicated with the drain port and a second state in which the introduction port and the first control port are communicated with each other occurs.

10. The variable displacement pump as claimed in claim 9, wherein the switching mechanism comprises: a valve body having a second discharge port to which the discharge pressure is introduced, a communication port communicated with the second control oil chamber, and a second drain port communicated with a drain passage; and a spool valve body slidably disposed within the valve body to control a communication state of each of the ports, when the spool valve body is in the initial position, the communication between the second discharge port and another port than the second discharge port is limited and the communication port and the second drain port are communicated with each other, and, when the spool valve body is moved, the second discharge port is communicated with the communication port and the communication state between the second drain port and another port than the second drain port is limited.

11. The variable displacement pump as claimed in claim 10, wherein the spool valve of the switching mechanism is structured to be moved electrically.

12. The variable displacement pump as claimed in claim 11, wherein the second discharge port is communicated with a passage branched from a passage communicated between the first control oil chamber or between the first control port and the first control oil chamber.

13. The variable displacement pump as claimed in claim 12, wherein the communication port is communicated with a passage branched from a passage communicated between the second control oil chamber or between the second control port and the second control oil chamber.

14. The variable displacement pump as claimed in claim 13, wherein the spool valve of the switching mechanism is switched when the control mechanism is in the second state.

15. The variable displacement pump as claimed in claim 14, wherein the second discharge port and/or the communication port constitutes the aperture.

16. The variable displacement pump as claimed in claim 9, wherein the discharge pressure is introduced to one end section of the spool valve of the control mechanism which is not biased by the control spring via a discharge port and the spool valve is moved against the biasing force of the control spring such that the discharge port and the first control port are communicated with each other via the one end section of the spool valve.

17. The variable displacement pump as claimed in claim 9, wherein the drain port of the control mechanism has a smaller opening area than the aperture.

18. A variable displacement pump comprising:

a pump constituent body configured to rotationally be driven to vary volumes of a plurality of hydraulic oil chambers to discharge oil introduced from a suction section through a discharge section;

a variable mechanism configured to modify volume variation quantities of the hydraulic oil chambers opened to the discharge section according to movement of a movable member;

a biasing member configured to bias the movable member in a, state in which a spring load is given to the movable member in a direction toward which the volume variation quantity of one of the hydraulic chambers opened to the discharge section becomes large;

a first control oil chamber into which the discharge pressure is introduced to impart a force in a direction against a biasing force of the biasing member to the variable mechanism;

a second control oil chamber into which hydraulic oil is introduced to act a force in the same direction as the biasing force of the biasing member upon the variable mechanism;

a switching mechanism configured to switch between one state in which hydraulic oil that has a decreased pressure relative to the discharge pressure is introduced from the discharge section to the second control oil chamber and another state in which hydraulic oil within the second control oil chamber is exhausted; and a control mechanism configured to exhaust hydraulic oil within the second control oil chamber as the discharge pressure becomes larger and to adjust the pressure within the second control oil chamber in a pressure decrease direction when the switching mechanism introduces hydraulic oil whose pressure is decreased relative to the discharge pressure to the second control oil chamber during a high revolution of the pump.

* * * * *